United States Patent [19]

Irvine

[11] 4,441,988

[45] Apr. 10, 1984

[54] CATALYTIC REFORMER PROCESS

[76] Inventor: Robert L. Irvine, 214 Rec., 27040 Cedar Rd., Apt. Mark IV, Beechwood, Ohio 44122

[21] Appl. No.: 270,405

[22] Filed: Jun. 4, 1981

Related U.S. Application Data

[63] Continuation-in-part of Ser. No. 43,784, May 30, 1979, abandoned.

[51] Int. Cl.[3] ..... C10G 35/04

[52] U.S. Cl. ..... 208/64; 585/430

[58] Field of Search ..... 208/64; 585/430

[56] References Cited

U.S. PATENT DOCUMENTS

| | | | |
|---|---|---|---|
| 3,306,706 | 2/1967 | Schuman | 585/430 |
| 3,392,107 | 7/1968 | Pfefferle | 208/65 |
| 3,669,875 | 6/1972 | Plank et al. | 208/65 |
| 3,882,014 | 5/1975 | Monday | 208/134 |
| 4,119,526 | 10/1978 | Peters et al. | 208/64 |
| 4,136,015 | 1/1979 | Kamm et al. | 208/129 |
| 4,167,474 | 9/1979 | Sikonia et al. | 208/64 |
| 4,174,270 | 11/1979 | Mayes | 208/138 |
| 4,174,271 | 11/1979 | Mayes | 208/138 |

*Primary Examiner*—Curtis R. Davis

*Attorney, Agent, or Firm*—McAulay, Fields, Fisher, Goldstein & Nissen

[57] ABSTRACT

A catalytic reformer process for the production of hydrogen and a product of enhanced aromatic content comprises the utilization of a plurality of reactor stages wherein the heat in the effluent from the terminal adiabatic stage of a conventional adiabatic reactor train is utilized in an ascending temperature pattern reactor, termed an alkylcyclohexane converter, by means of simultaneous heat exchange, to provide the endothermic heat of reaction required for the dehydrogenation to aromatics of the original alkylcyclohexanes in the feed. An ascending temperature pattern reactor, termed an alkylcyclopentane converter, may optionally be employed wherein heat supplied from stack gases generated by the conventional fired heaters in an adiabatic reactor train can, additionally, be employed to supply heat to such converter. With this reformer process, byproduct is improved as to hydrogen yields, at the expense of methane, ethane, and propane, the hydrogen having improved purity, and gasoline, and its characteristics, for a given research octane clear quality for a given feedstock, is produced in a thermally more efficient manner.

13 Claims, 5 Drawing Figures

CATALYTIC REFORMER PROCESS

CROSS REFERENCE TO RELATED APPLICATION

This is a continuation-in-part of my copending application Ser. No. 43,784 for Catalytic Reformer Process, filed May 30, 1979 and now abandoned.

This invention relates to the catalytic reforming in a thermally efficient manner of hydrocarbon fractions, to improve hydrogen yields and pentane plus values in the gasoline product of a given octane quality obtained from a given feedstock. The aromatics yield significantly increases for a given severity of treatment, primarily at the expense of decreased hydrocracked paraffins in the product, so the hydrogen byproduct purity is significantly increased by the process of the invention.

The invention accomplishes this result by providing an alkylcyclohexane converter utilizing the sensible heat in the reactor effluent from the terminal reactor of a series of reactors to provide, by simultaneous heat-exchange, the endothermic heat of reaction required for the dehydrogenation of the original alkylcyclohexanes in the feed to aromatics. As both the feed to the converter and the reactor effluent contain hydrogen as the principal component, the heat transfer characteristics are excellent and well suited, so that heat exchange can be accomplished economically with a limited surface. Because the alkylcyclohexanes dehydrogenate rapidly, only a limited catalyst volume is required and suited to the conventional heat-exchanger tube diameters available.

Catalytic reforming reactors to-day consist of fixed bed adiabatic reactors to perform all the catalytic reactions required in catalytic reforming with a platinum-containing catalyst. These adiabatic reactors, while very suitable for carrying out the slower paraffin dehydrocyclization reactions in forming aromatics, suffer a serious disadvantage in comparison with the process of the invention in dehydrogenating the naphthene components entering in the feed because, by their nature, they must be heated to a temperature level higher than the bed outlet temperature, to provide the endothermic heat of reaction. Higher temperatures result in decreased molar selectivity for the naphthene components to aromatics. The lead adiabatic reactor usually has a sharply falling temperature drop of at least 120° F. for the lower pressures made practicable by the development of promoted platinum catalytic reforming catalyst, with the addition of metals such as rhenium.

These promoted or multi-promoted platinum catalysts enhance the thermal stability and reduce the tendency of the previous best platinum on alumina catalysts to agglomerate and to form larger platinum sizes by a factor of 5 or more. The larger the platinum size, the less effective is the catalyst for naphthene dehydrogenation or overall paraffin dehydrocyclization reactions. On the other hand, platinum size does not affect the hydrocracking activity so that platinum catalysts prior to the development of promoted platinum catalysts (first commercial tests commenced in 1968) had, with semi-regenerative adiabatic reactor arrangements, a sharp decrease in pentane plus yields and hydrogen purity as the temperatures increased to compensate for declining activity.

Platinum sintering or agglomeration of the platinum particles is a second order reaction strongly dependent upon the temperatures prevailing in the bed and, being a time-temperature function, semi-regenerative adiabatic reactor arrangements are most affected. With the promoted catalyst development, instead of a sharp yield decline when temperatures above 970° F. were approached, the yield and hydrogen purity decline were gradual, even when temperatures were increased to 1,020° F.

These temperatures were permitted by another characteristic of the promoted plantinum catalysts. Thus, the previous best platinum only catalysts have carbonaceous deposits up to 10 weight percent, based on the original catalyst weight, in the terminal reactor, corresponding to the highest carbonaceous deposits on the catalyst, as the catalyst is subject to the lowest hydrogen partial pressure, the highest average bed temperature, the highest concentration of aromatics and the greatest hydrocracking activity, all of which adversely affect the carbonaceous deposition. In contrast, the promoted catalysts, without any sharp yield declines, can routinely have carbonaceous deposits of 15 to 20 weight percent, and be regenerated (oxidation of the carbonaceous deposits, chlorination or haliding to restore original halogen content, rejuvenation or redispersion of any agglomerated platinum into smaller sizes, and reduction by hydrogen with limited $C_2$ plus hydrocarbon content) with full restoration of their fresh catalyst activity. This meant that lower operating pressures became practicable for even the semi-regenerative adiabatic reactor arrangement. The Chevron Research Company, the original developer of promoted platinum catalyst technology, has recently reported, for example, that converted semiregenerative units, with the reactors containing the most recently developed promoted catalyst have operated with molar hydrogen to feed ratios for the hydrogen recycle of from 2.5:1 to 3:1, and at 100 to 200 psig at the last reactor outlet, with cycles in excess of six months between regenerations.

All the major licensors of catalytic reforming technology have now either adopted or separately developed a promoted or multi-promoted platinum catalyst for use in their licensed process, so that the adoption of lower pressures has been made practicable whatever the reactor arrangement.

The benefits of lower pressure had been previously demonstrated by the cyclic or swing reactor arrangement using previous platinum catalyst technology. In the cyclic or swing reactor arrangement, a reactor is regenerated onstream while processing with the other reactors. The regeneration is carried out by isolating the reactor previously in the terminal reactor position with separate regeneration equipment. After regeneration, including chlorination, rejuvenation (then more important) and hydrogen reduction, the regenerated reactor is placed in parallel with the lead reactor position, the parallel previous lead reactor is placed in parallel with the intermediate reactor position, the parallel previous intermediate reactor is placed in parallel with the terminal reactor position, and the previous terminal reactor is regenerated. In this cyclic reactor arrangement, all the reactors, including the swing reactor being regenerated, are of similar volume, and have double block valves permitting them to be connected to the heaters for the various reactor positions. This additional equipment enables such a reactor arrangement to process continuously while regeneration and rejuvenation are carried out onstream, but the reactors in the major commercial processes today are adiabatic and have essentially the same reactor characteristics. The important point is that, while the regeneration methods may differ, all existing processing arrangements for catalytic reforming have the same inherent kinetic disadvantage in the case of the conversion of the original naphthene components in the feed by means of adiabatic reactors.

The other major commercial catalytic reforming process is the "continuous" reactor arrangement. This variation of the adiabatic reactor arrangement differs in the regeneration only, which is also carried out onstream while processing feedstock in the normal manner. In this arrangement, a small stream of catalyst is transported using hydrogen for the pneumatic transport from the lift pot at the base of the reactor to a surge hopper above the regeneration vessel. Small batches of catalyst are periodically regenerated, including chlorination, rejuvenation, if necessary, and reduction by hydrogen with the regenerated catalyst proceeding to a surge hopper. Generally, the reactors are stacked with the lead reactor on the top and the terminal reactor on the bottom, so that with the surge hopper immediately above the lead reactor, regenerated catalyst enters the lead reactor by gravity. Transfer between the reactors is also by gravity (the catalyst settles in the reactors in plug flow because of the small stream of catalyst being withdrawn and added). In this manner, the attrition of catalyst is limited as only the catalyst to be regenerated must be pneumatically transported. The continuous reactor arrangement, unlike the cyclic reactor arrangement, can utilize the same reactor catalyst distribution now generally employed for the semi-regenerative reactor arrangement, which consists of the smallest reactor volume vessel being in the lead reactor position and the largest reactor volume vessel being in the terminal reactor position. This reactor catalyst distribution utilizes catalyst more efficiently, as the faster reactions at the lead reactor require only a limited reactor volume before the fall in temperature sufficiently retards further desired reactions thermodynamically. In contrast, the terminal reactor position is concerned with converting the least reactive components, generally $C_6$ and $C_7$ paraffins which have considerably slower overall paraffin dehydrocyclization rates than the higher carbon number paraffins. Slower reaction rates require greater catalyst volume so that increased hydrocracking relative to the formation of aromatics is inevitable, but the use of higher space velocity for the faster reactions decreases the time that the entire feed can undergo hydrocracking reactions. Hydrocracking being a consumer of hydrogen is exothermic so that temperature drops in the terminal reactor are limited as these exothermic reactions act to offset the endothermic requirements resulting from the dehydrocyclization of paraffins into aromatics.

Reformer art today commercially employs adiabatic reactors filled with a platinum based reforming catalyst for all the conversion levels including the initial conversion level (lead adiabatic reactor in conventional reforming). This might be better termed conventional reforming because this, with possibly one or two exceptions, represents the commercial practice today.

Because of the elevated temperatures involved and the overall endothermic reaction heat involved, each conversion level in conventional reforming commercially uses a fired heater to preheat the process fluid, which includes the applicable hydrogen recycle in addition to the reactants originating from the original naphtha feed, which in turn enter the adiabatic reactor to provide the necessary inlet temperature desired for the conversion level. A conventional reforming conversion level which commercially consists of a fired heater followed by an adiabatic reactor is traditionally called a stage. Most commercial reformers consist of three or four stages in series. Five stages are occasionally employed with a design feedstock having a high naphthene content and a high conversion of the original feed saturates. More than one reactor vessel is sometimes used for the adiabatic reactor, usually in parallel to limit pressure drop and with a common fired heater.

Reforming reactor vessels of commercial size are insulated and contain comparatively large volumes of reforming catalyst relative to the reactor vessel surface area. The term adiabatic derives from the thermodynamic meaning, because no heat is added to the reactor after introduction of the feed and the heat losses from the reactor to the surroundings are limited commercially. A small increase in the feed inlet temperature, usually well within the accuracy of thermocouples employed for temperature measurement, compensates for the heat loss from most commercial reactor vessels. Overall reaction heat within a particular adiabatic reactor is provided by temperature differences corresponding to the inlet temperature and the outlet temperature for the particular reactor with sensible heat corresponding to the average specific heat of the entering and leaving process gas streams (although the gas streams are under pressure, atmospheric specific heat is applicable with little error due to the presence of hydrogen). In conventional reforming, the fired heater for the lead adiabatic reactor is called traditionally a charge heater, and the fired heaters for successive stages are usually termed interheaters.

Mayes U.S. Pat. Nos. 4,174,270 and 4,174,271 share a common process flow drawing which represents a common arrangement of a four stage semi-regenerative conventional reformer. Method of regeneration affects only the onstream time, not the inherent kinetics of adiabatic reactors. The regeneration method does not alter arrangements other than semi-regenerative from being conventional reforming. The semi-regenerative reformer, designed for intermediate cycle length (usually twice a year regeneration), and employing a platinum based catalyst (usually a rhenium promoted platinum catalyst) accounts for over 65% of today's gasoline reformers.

The inlet temperatore pattern for the adiabatic reactors depends upon the process licensor. Most licensors employ either an equal adiabatic reactor inlet temperature pattern, for a slightly downhill adiabatic reactor inlet temperature pattern, wherein temperature differences for the inlet temperatures between successive stages decline approximately 5° F. in the usual temperature pattern for platforming as licensed by UOP.

A semi-regenerative arrangement commences each startup with fresh catalyst activity. Assuming no permanent poisons enter the reactor system in the interim, fresh catalyst activity is essentially restored with the regeneration at the end of the cycle (EOC). Oxidation of the carbonaceous deposits on the reforming catalyst removes carbon as carbon dioxide and hydrogen as water. At startup, the temperatures at the start of the cycle (SOC) are adjusted in accordance with temperature pattern to compensate for activity decline onstream due to the carbonaceous deposits on the reforming catalyst and continue until regeneration is required. Regeneration can occur for a number of reasons other than the carbon content in the terminal adiabatic reactor having increased to the level where regeneration is usually justified from an overall cycle yield viewpoint such as: permanent or temporary poisons causing undue yield decline, excessive reactor pressure drop, heater outlet temperature approaching metallurgical limit, or simply shutdown may be convenient from a mechanical overhaul schedule.

Pfefferle U.S. Pat. No. 3,392,107 represents a significant improvement in the art of conventional reforming. The concepts in this patent were the basis for developing Magniforming, which is jointly licensed by ARCO and Engelhard. For a given catalyst, with the feed and product quality of the reformate being the same, Magniforming provides an improved selectivity compared to previous equal or slightly downhill adiabatic, semi-regenerative reactors. Magniforming temperature patterns usually consist of a nearly constant inlet temperature of approximately 890° F. for the first conversion adiabatic reactor stage, approximately 10° F. higher inlet for the second conversion adiabatic reactor stage, and approximately 15° F. higher for any successive conversion stage inlet, if more conversion stages are required before the bulk of the original feed naphtha feed disappears. Supplemental recycle hydrogen is then introduced with the process stream leaving the final naphthene conversion stage to enter the fired heater for the first of the paraffin dehydrocylization stages if more than one is required. The paraffin dehydrocylization stages, which always include the terminal adiabatic reactor, are operated in a manner similar to an equal temperature adiabatic reactor inlet pattern, with a gradual increase in inlet temperature with onstream time to maintain the required quality of the reformate product. The role of hydrogen recycle is dual fold for an adiabatic reactor in that, in addition to limiting the carbonaceous deposits, the hydrogen recycle also provides additional sensible heat to the entering reactants derived from the feed to prevent excessive temperature drop from the endothermic reactions occuring within a reactor. This could be important at the lead adiabatic reactor in reducing losses occurring in reversals of equilibria, or for the terminal adiabatic reactor to achieve a practicable onstream operating range because the SOC inlet temperature is excessive.

Although a higher temperature increases all reaction rates, the alkylcyclopentanes and paraffins of given carbon number cannot take any advantage of this until the original alkylcyclohexanes of the same carbon number have been sufficiently lowered in concentration so that a favorable thermodynamic equilibria exists. The alkylcyclopentane ring rearrangement into alkylcyclohexanes and the paraffin dehydrocyclization into alkylcyclohexanes is a reversible reaction, unlike hydrocracking which is irreversible. Alkylcyclopentanes and alkylcyclohexanes can also decyclize and hydrogenate to form paraffins—and do so when conditions are favorable. The dehydrogenation of alkylcyclohexanes into the alkylcyclohexene intermediate and further dehydrogenation into aromatics (alkylbenzenes) is also a reversible reaction which is subject to thermodynamic equilibria. The alkylcyclohexene reaction is a very fast reaction. The alkylcyclohexane dehydrogenation into an alkylcyclohexene intermediate, while fast compared to the other reactions occurring, is slow compared to the alkylcyclohexene dehydrogenation into aromatic reaction. The alkylcyclohexane dehydrogenation into the alkylcyclohexene intermediate, therefore, controls the lowering of the original alkylcyclohexane concentration and time is required. In the meantime, while the high original concentrations of alkylcyclohexanes in the feed are being sufficiently reduced by conversion to aromatics, only non-desired degradation reactions can occur on the acid sites, e.g. isomerization of normal paraffins to iso paraffins, decyclization of naphthene components into paraffins, alkylcyclohexanes, where conditions are favorable, and hydrocracking. These competitive reaction rates are also speeded up by the high temperatures prevailing at the inlet of the reactor. Thus the original saturate feed components can directionally only proceed towards hydrocracking as all aromatics formed must proceed through the alkylcyclohexene dehydrogenation intermediate. The alkylcyclopentanes, being initially prevented by thermodynamic equilibria from ring isomerization into alkylcyclohexanes in the meantime can only decyclize and hydrogenate to form paraffins which reinforce the hydrocracking reaction losses. This reaction is a reversible reaction in that paraffins may also dehydrocyclize the alkylcyclopentanes but this competitive pathway is not available until the original concentration of the original alkylcyclopentanes has also been lowered and a favorable thermodynamic equilibria exists for the paraffin concession.

Higher temperatures unfavorably affect the molar ratios at thermodynamic equilibria important for the selective conversion of the original naphthenes in the feed into the aromatics. The ring isomerization of alkylcyclopentanes into alkylcyclohexanes is a good reaction to show temperature effect as this equilibria, unlike the dehydrogenation or dehydrocyclization reactions (favored by lower hydrogen partial pressure because hydrogen is produced) or the reverse reactions (favored by higher hydrogen partial pressure because hydrogen is consumed) is little affected by hydrogen partial pressure. For example, mols of alkylcyclopentanes per mol of alkylcyclohexane at thermodynamic equilibria are:

| | 800° F. | 900° F. |
|---|---|---|
| $C_6$ naphthenes | 9.0 | 11.5 |
| $C_7$ naphthenes | 2.7 | 3.2 |
| $C_8$ naphthenes | .265 | .43 |
| $C_9$ naphthenes | .087 | .175 |

The inlet temperature to the lead adiabatic reactor is generally never less than 880° F. For the increasing octane requirements, with increasing lead additive legal restrictions being enacted, at least in the United States, inlet temperatures for an equal reactor inlet pattern of the order of 930° F. are likely for the typical hydrotreated straight run feedstocks similar in quality to naphtha derived from Kuwait crude, even for the start of run conditions with a semi-regenerative reactor arrangement. The other reactor arrangements generally practice higher reactor inlet temperatures than 930° F. as the catalyst inventory is generally smaller due to the ability to regenerate onstream to compensate for catalyst deactivation. Furthermore, continuous processing reactor arrangements do not normally regenerate the catalyst in the reactors at shutdown unless entering a reactor is required during the shutdown, whereas a semi-regenerative reactor arrangement starts up with freshly regenerated catalyst in all reactors as the hydrogen circulating equipment is employed for regeneration. Each semi-regeneration run, thus, commences with fresh catalyst as in the initial startup with new catalyst. For the heaters designed for equal reactor inlet pattern, if octane requirements increase, one commences with a higher start of run inlet temperature to the adiabatic reactors in order to meet the quality demanded.

The process of the invention in contrast, commences with an inlet temperature below 700° F. for most design cases into the alkylcyclohexane converter. This lower entering temperature together with an outlet temperature below 800° F. for most design cases for the alkylcyclohexane converter significantly lowers the hydrocracking activity in addition to lowering the competitive reactions which cause loss of the original alkylcyclopentane and alkylcyclohexane components in the feed. Once alkylcyclohexane is converted to a component having a slower reaction rate for the overall conversions into aromatics, additional hydrocracking is inevitable even though part of this component is later converted into aromatics.

As may be seen from the above favorable thermodynamic equilibria at 800° F. as compared to 900° F., the ring isomerization of alkylcyclopentanes into alkylcyclohexanes can commerce sooner if the alkylcyclohexanes are dehydrogenated at a lower temperature. This decreases the conversion of alkylcyclopentanes into paraffins particularly for the higher carbon numbers which also have the highest reactivity.

Although one generally considers the alkylcyclopentane isomerization reaction into alkylcyclohexane as slow compared to the rate for the dehydrogenation rate of alkylcyclohexanes into aromatics, one must consider the carbon numbers because of increased reactivity with carbon number.

The highest carbon number ring isomerization is, therefore, comparable in rate to the lowest carbon number alkylcyclohexane dehydrogenation rate. Thus, the more preferential enhancement of the depletion of the original alkylcyclohexane in a rising reactor means that considerable $C_9$ and higher alkylcyclopentane conversion into aromatics could occur concurrent with significant cyclohexane conversion into benzene. Reactions for the lower carbon number alkylcyclohexanes occur later as the dehydrogenation sites in the early part are preferentially occupied with the dehydrogenation of the higher carbon number alkylcyclohexanes into aromatics until their original concentration drops sufficiently to permit more competitive access.

The alkylcyclopentane route to the alkylcyclohexane intermediate which is finally dehydrogenated into aromatics in overall paraffin dehydrocylization is considered by most investigators from pure component and mixture studies to be at least as important as the alkylcyclopentane route. This means that until the original alkylcyclopentanes are reduced to sufficiently low concentration, as required by thermodynamic equilibria, unnecessarily high temperatures increase the hydrocracking of the paraffins and the isomerization of the original normal paraffins to less convertible isoparaffins. The time period required to reduce the original alkylcyclopentanes to sufficiently low concentration that a transition to higher temperatures should be considered, because paraffin dehydrocyclization can proceed without undue competition, is longer than for the reduction of alkylcyclohexane even though the average temperature is higher.

Catalyst volumes required for the alkylcyclopentane converter appear consistent with that required for economic recovery of sensible heat from the flue gases of the fired heater section. Catalyst volumes for the alkylcyclohexane and alkylcyclopentane converter are more related to that catalyst volume required for heat recovery than that required for kinetic considerations.

Apart from any kinetic considerations, the alkylcyclopentane coverter provides a very efficient convection fraction for the process heater, particularly with the comparable low temperature into the convection section (alkylcyclopentane converter) from the alkylcyclohexane converter output.

This enables using all radiant fired heater section to heat the feed streams to the various adiabatic reactors economically without the necessity for generating intermediate pressure steams. All radiant fired heater sections have the advantage of both a high heat flux and correspondingly low pressure drop. The alkylcyclopentane converter has a convection bank employing endothermic reaction heat in a similar manner to a steam generator using latent heat or vaporization.

As the radiant flux rate in an oil radiant fired section for a new design is related to the flue gases leaving the fired heater section, comparably high flux rates can be afforded for the fired oil radiant heater sections for the adiabatic reactor because the flue gas quantity is practically independent of the distribution of duties before the fired radiant heater section for the adiabatic heater sections, and the alkylcyclopentanes converter which serves as a converter bank, and the increase in the alkylcyclopentane converter absorbs pressure heat duty simply and, for the most part, reduces the charged heater absorbed heater duty. Thus, a high radiant flux is obtained economically due to the alkylcyclopentane converter increasing the overall process heater efficiency in excess of 80%, or in excess of 90% if a combustion air heater is added.

For the alkycyclopentanes lower temperatures than the adiabatic reactors results in more favorable thermodynamic equilibria (greater driving force) for conversion into the alkylcyclohexane intermediate for conversion into aromatics. For the normal paraffins lower temperatures reduce the reaction rate for isomerization into isoparaffins with less driving force (lower temperatures correspond thermodynamically to higher paraffin content) and the high space velocity reduces the residence time for the reaction to occur. This together with the lower reaction rates for hydrocracking of the paraffins acts to preserve the favorable normal paraffin contents until their introduction into an adiabatic reactor at high temperature when both pathways (alkylcyclohexane) to the desired aromatics are operational.

With hydrogen imparting good heat transfer characteristics inside the catalyst tube and endothermic reactions limiting temperature rise of the fluid in a manner similar to vaporization of water in a high pressure steam generator, the catalyst tubes may be safely finned for more economical heat transfer. The atmospheric flue gases have comparatively poor heat transfer characteristics as compared to hydrogen (principal component inside the catalyst particles). Adiabatic equivalent temperature drops are of the order of 65° F. for the alkylcyclopentane converter due to the endothermic reactions overall (slight exothermic reactions occur).

Although pressure drop is significant for the alkylcyclopentane converter, this pressure drop affects only the hydrogen recycle compressor discharge pressure and does not affect any of the adiabatic reactor outlet pressures. With suitably shaped catalyst particles, for example the ring catalyst in the tubes of the alkylcyclopentane and alkylcyclohexane converters, a high mass flow rate per unit cross section can be obtained with reasonable pressure drop (approximately 6 psi). Inside heat transfer coefficients are related to mass flow rate within the tube and this is generally preferred with the shape catalyst particles to operate several times that generally practiced commercially in an adiabatic reactor.

For comparison a low pressure drop radiant heater together with its adiabatic reactor (also of low pressure drop design) total approximately 10 psi pressure drop. The alkylcyclopentane converter together with the alkylcyclohexane converter for the Kuwait naphtha example discussed later provides a net addition of 0.876 mols of hydrogen per mol of feed. The Kuwait naphtha represents a low endpoint paraffinic feedstock which contains 2.5 liquid volume percent $C_6$ paraffins. This example may be considered representative of the lower naphthene content to be encountered in commercial practice so that the molar hydrogen recycle per mol of feed could be 2.3 for preliminary evaluation work without pioneering in commercial adiabatic reactor practice as over 3 mols of hydrogen per mol of feed would be provided when the feed is first heated to higher temperatures to enter the lead adiabatic reactor. The reduction in hydrocracking by products due to more selective conversion of original naphthenes in the feed into aromatics improves the purity of the hydrogen so that approximately 20 percent less hydrocarbon byproducts are recycled with the hydrogen recycle. This together with less overall hydrocarbon byproducts being formed during the processing of the feed means that the hydrogen partial pressures in the terminal reactors which operate with 3 mols of hydrogen per mol of feed at the same reactor effluent separator pressure. The higher hydrogen purity of the hydrogen recycle further reduces the value of hydrogen recycle to be compressed in the invention. Thus the hydrogen compressor horsepower requirement decreases for the same operating pressure level as compared to existing catalytic reformers because the decrease in volume of the hydrogen cycle appreciably more than offsets the hydrogen recycle increased circuit pressure drop (allowing no credit towards the decreased pressure drop in the feed-reactor exchanger as a result of the alkylcyclohexane converter or decreased pressure drop in the heaters, adiabatic reactors, and aircooler because of the lower hydrogen recycle).

It is recognized that adiabatic reactors require a minimum hydrogen recycle rate in order to limit the temperature drop in the lead reactor. This has been provided even though with the process of the invention the adiabatic temperature drops within the adiabatic reactors considerably decrease, particularly the lead adiabatic reactor because the most reactive feed components have been converted into comparatively inert aromatics and hydrogen. With the process of the invention these products are sensible heat carriers for the other reactions occurring in the lead reactor similar to the original hydrogen recycle (instead of producing endothermic reactions which quench the other reactions from ever occurring in the lead adiabatic reactor).

The process of the invention admirably suits the trend in modern catalytic reformer design of employing radiant fired heater sections exclusively to heat the feed streams to the required inlet temperature for the respective adiabatic reactors in order to reduce the hydrogen compressor circuit pressure drop (because compressor horsepower is related to the pressure ratio of the discharged pressure to the suction pressure; in absolute terms circuit pressure drop becomes more important the lower the operating pressure). The process of the invention provides an economical solution for the efficient use of the flue gasses from these radiant fired heater sections. With an overall adiabatic temperature drop equivalent of 150° F., for both the alkycyclohexane converter and the alkylcyclopentane converter, it may be seen that not only is the heat provided for the elimination of the hydrocracking reactions formerly occurring in the adiabatic reactors in the conversion of the naphthenes, but is also sufficient to actually reduce the energy required for the adiabatic reactor heaters assuming that the reactor inlet temperatures remain unchanged. This is a conservative assumption as the average temperature within the adiabatic reactor bed significally increases for the same reactor inlet. This could be corrected in a new design with lower catalyst inventories in the adiabatic reactors. The overall catalyst inventory with the process of the invention decreases, particularly as the adiabatic reactors are concerned with the slower reactions and most of the catalyst volume is in the adiabatic reactors. The foregoing should be sufficient to indicate that the process of the invention should contribute towards lowering the energy cost of existing catalytic reforming processes.

The lower nearly constant inlet temperatures throughout the cycle are taken advantage of in a split hydrogen recycle flow arrangement by using lower hydrogen recycle than normal at the lead adiabatic reactor inlet, such as that equivalent to 3 mols of hydrogen per mol of naphtha feed used in Example 1 of Pfefferle's patent, with a platinum-only based catalyst. This provides a lower hydrogen partial pressure which favors more selective conversion of naphthenes into the same carbon number aromatic and further decreases hydrocracking rates in the stages where the highest concentrations of saturates occur.

Commercial Magniforming experience, which includes modifications of existing reformers previously practicing an equal temperature adiabatic reactor inlet pattern and using the same Engelhard reforming catalyst, has demonstrated thoroughly the increased selectivity advantage over an equal temperature adiabatic reactor inlet pattern using the same given feed and given operating pressure. The increased hydrogen yields of higher purity and pentane plus reformate yields of the same product quality at the expense of methane through butane yields confirm Pfefferle's reasoning that lower temperatures during the bulk conversion of the original naphthenes are desired to limit hydrocracking losses.

The selectivity yield gains for the application of an alkylcyclohexane converter to Magniforming are less than those with an equal adiabatic reactor inlet temperature pattern for the same given feed because a substantial part of the decreasing hydrocracking due to lower temperatures has already been obtained. Considering that the use of an alkylcyclohexane converter eliminates or overcomes some of the inherent kinetic deficiencies from using an adiabatic reactor for the initial stage of conversion, an incremental further hydrogen gain of at least 0.001 weight fraction of the naphtha feed is expected, whatever the temperature pattern practised for the adiabatic reactors, including Magniforming.

The greatest drawback of an adiabatic reactor for an initial conversion level is that an adiabatic reactor subjects the highest carbon number, most reactive components in the original feed to a much higher temperature than necessary when contacting a dual functional catalyst where desired reactions resulting in intermediates ultimately forming aromatics are thermodynamically prohibited. The acid sites, apart from forming lower carbon number fragments, by default, only participate in ring isomerization to alkylcyclopentanes and ring opening to paraffins as long as the original feed alkylcyclohexanes are in excess of that required by equilibria considerations. In the meantime, the alkylcyclopentanes of the particlar carbon number can only ring open to paraffins and, for straight run feeds, the normal paraffins isomerize to isoparaffins. All these thermodynamic equilibria reactions act to increase the hydrocracking in later reactors as well as decrease the selectivity of the original higher carbon number saturates to aromatics. Hydrocracking, demethylation and deethylation are never limited by thermodynamic equilibria but rates are affected by competition for acid sites, hydrogen partial pressure and temperature, all of which favor the use of an alkylcyclohexane converter for the initial conversion. This higher temperature than necessary (some 130° F. higher based upon Example 1 of Pfefferle's patent) results in a poorer yield of the same carbon number aromatics from the feed alkylcyclohexanes dehydrogenated in the alkylcyclohexane converter. The lower carbon number aromatics formed act to provide a less favorable equilibria for the lower carbon number naphthenes which increases the ring opening for the lower carbon number alkylcyclopentanes in the lower portion of the lead adiabatic reactor. Although not recognised in Pfefferle's patent, subsequent data by Engelhard's authors ("Mass Velocity Effects in an Adiabatic Pilot Plant Simulation of Commercial Catalytic Reforming" by A. E. Eleazar, G. W. Roberts, H. F. Tse and R. M. Yarrington, Ind. Eng. Chem. Process Des. Dev., Vol. 17, No. 4, 1978, page 393) show that the kinetic drawback for adiabatic reactors due to the sharply falling temperature in the early stages from possible reversal of thermodynamic equilibria for the lower carbon number alkylcyclopentanes is an important consideration under commercial Magniforming conditions as long as naphthenes remain in significant concentration. A 1.3 weight percent decrease in pentane plus reformate yield occurred in pilot plants for the same feed and conditions for the extremes of mass velocities tested. This was reasoned logically to be due to decreased catalyst particle temperatures in the lower portion of the naphthene conversion stages. Increased differences between the temperature of the bulk gas (entire heating mechanism in an adiabatic reactor) and the temperature of the catalyst particles were calculated for various mass velocities corresponding to the pilot plant condition. It may be noted that the addition of an alkylcyclohexane converter for Pfefferle's Example 1 increases the outlet temperature of the naphthene converters (Nos. 1, 2 and 3) significantly more than the calculated differences for the extremes of mass velocity tested, so these reversal losses are either averted or significantly reduced.

Preferential selective disappearance of the higher carbon number alkylcyclohexanes commencing with the highest carbon number and progressing downwards until equivalent to the net heat available for overall endothermic reactions is facilitated by the overall rising temperature within the alkylcyclohexane converter by the effective use of chemisorption. This results in a significant reduction of lower carbon number by-products and lower carbon number aromatics, as well as prevents the components with the lowest initial thermal energies from being subjected to the higher temperatures within the charge heater. The almost negligible concentrations of the higher carbon number alkylcyclohexanes reduces the concentration of saturates in the lead adiabatic reactor as the higher carbon number alkylcyclopentanes can use the hot acidic sites immediately with a high turnover because of favorable equilibria for ring isomerization and, similarly, higher carbon number paraffins can ring close to alkylcyclohexane intermediates. This faster disappearance of the higher carbon number saturates by reducing the opportunity for hydrocracking decreases the pentane, hexane and heptane byproducts, all of which are of low octane number. The more isothermal nature of the adiabatic reactors, due to the use of the alkylcyclohexane converter for the initial stage of conversion, acts to increase turnover in the lower portion of the reactors so that normal paraffins have less opportunity for isomerizing to isoparaffins and the lower carbon number saturates to hydrocrack.

Incremental hydrogen represents a good measure of selectivity gains because 5 mols of hydrogen result when an incremental mol of saturate (naphthene or paraffin component) previously hydrocracked is converted more selectively into an aromatic of the same carbon number.

Each 0.001 weight fraction incremental hydrogen yield causes approximately a 25° F. overall increase in the bed temperature drops for a conventional reformer practising a hydrogen recycle of 3 mols of hydrogen per mol of naphtha feed at the inlet to the lead adiabatic reactor.

As may be expected, Magniforming, in common with any other form of conventional reforming which increases selectivity, has disadvantages of increased investment. This is due to the additional and incremental equipment required for a split hydrogen recycle flow, as well as significantly increased utility costs as compared to the less selective reformers when employing the same feed approach temperature of the inlet feed and for the supplemental hydrogen recycle to the fired heater of the first paraffin dehydrocylization stage.

Pfefferle's patent process flow represents a typical four stage Magniforming arrangement when the design feed has a high naphthene content and, therefore, may be considered applicable to Pfefferle's Example 1 which shall be studied further to compare utility requirements for the base case (Example 1) and for the base case having an alkycyclohexane converter added. This indicates that the process of the present invention has the potential to achieve a breakthrough in utility costs regardless of the adiabatic arrangement while retaining the inherent selectivity features, or better, of Magniforming.

The restraint on obtaining higher selectivities is not technical but economic, particularly the cost of utilities today. Chevron, who developed the original bimetallic reforming catalyst (rhenium promoted platinum catalyst), did extensive testing in their pilot plants evaluating the effect of 100 psig terminal adiabatic reactor pressures and commercially confirmed the yield advantages to 125 psig by 1972 as indicated by pilot plant studies, and delivered an API paper in 1973 recommending such lower pressure operations as probably being the most profitable investment for reforming.

Chevron's licensed process, "Rheinforming," is a semi-regenerative arrangement designed for an equal adiabatic reactor inlet temperature pattern. Today, Chevron is constructing 150 psig units (National Petroleum Refiners 1978 Annual Meeting Paper AM-76-57 "New Developments in Rheinforming" by W. C. Buss, R. L. Jacobson, F. H. Vorhis) because refinery fuel and power costs have risen more than naphtha feedstock costs so that lower pressures are no longer economically justifiable. Incremental hydrogen recirculation is always required for a semi-regenerative arrangement when decreasing pressure for the same feed, catalyst, and product quality in order to provide the same on-stream cycle time. A lower pressure operation must, in addition, compress the hydrogen byproduct to the base pressure level.

Magniforming, with nearly constant inlet temperatures to the naphthene stages, requires a higher hydrogen recycle in the controlling terminal adiabatic reactor. The terminal adiabatic reactor for conventional reformers paracticing an equal temperature adiabatic inlet pattern generally has carbonaceous deposits of approximately 2.5 times that found at the end of cycle in the preceding adiabatic reactor. This is necessary because not only is the SOC average bed temperature in Magniforming higher than for an equal temperature adiabatic reactor inlet pattern arrangement but paraffin dehydrocyclization stages must compensate for the comparatively low average reactor temperatures for the naphthene converters throughout the cycle as well as for the effect of the lowering of the average bed temperatures due to increased selectivity through increased temperature drops. The higher average temperature requirement for the paraffin dehydrocyclization stages, which always include the controlling terminal adiabatic reactor, increases carbonaceous deposition rates which must be counteracted by more supplemental hydrogen recirculated (lowers mass transfer coefficient which affects the transport of coke precursors from the catalyst surface and increases the hydrogen partial pressure). Magniforming must further increase the hydrogen recirculated because only part of the reactor catalyst inventory actually increases the inlet temperature to compensate for the onstream activity decline for the entire reactor catalyst inventory. The effect of the most recent rhenium promoted platinum catalyst has been to lower Pfefferle's supplemental recycle rates of 7 to 30 to the range of 3 to 8 for recently designed units. Magniforming selectivity versus utilities is competitive because Magniforming accounts for approximately 10% of the recent catalytic reformer capacity.

A summary of a utility study using Pfefferle's patent Example 1 for base conditions follows using typical compositions and other information from studies for modifying existing reformers. The study is based upon maintaining the same 3 mols of hydrogen per mol of naphtha feed at the inlet of the lead adiabatic reactor as this is the first higher temperature catalyst contacted. The lead adiabatic reactor thus becomes the second conversion level and the inlet temperature, therefore, corresponds to that used for the No. 2 reactor in the base. Similarly, inlet temperatures have been adjusted for the successive naphthene stages. The same paraffin disappearance on the original naphtha feed is used with selectivities for paraffins to aromatics unchanged. Selectivities for paraffins to aromatics can only improve under the modified case because of less opportunity for hydrocracking. The overall weight average bed temperature for the modified case is based upon a conservative 5° F. decrease because of the contribution by the alkylcyclohexane converter due to the higher carbon number alkylcyclohexanes not competing with the lower carbon number alkylcyclohexanes remaining in the lead adiabatic reactor. Higher carbon number saturates are able to utilize the lead adiabatic reactor acid sites from initial contact with the catalyst particles in this reactor for desired aromatic formation reactions. The limiting reactions are accomplished more easily and more efficiently because of the more isothermal behavior of the adiabatic reactors in the modified case which avoids reversals in equilibria.

Example 1 Base Temperatures °F. for Start of Cycle (SOC)

| Adiabatic Reactor | Inlet | Bed Temperature Drop | Outlet | WABT[a] | Overall Endothermic Btu/lb Naphtha Feed | Endothermic Distribution Fraction |
|---|---|---|---|---|---|---|
| No. 1 | 890 | 120 | 770 | 830.0 | 123.3 | .399 |
| No. 2 | 900 | 95 | 805 | 852.5 | 100.9 | .326 |
| No. 3 | 915 | 50 | 865 | 890.0 | 54.9 | .177 |
| No. 4 | 965 | 15 | 950 | 957.5 | 30.3 | .098 |
| Overall | | 280 | | 907.4 | 309.5 | 1.000 |

[a]Weight average bed temperature is based upon 1:1:1:3 catalyst distribution given. The individual average reactor temperature is considered to be simply the average of process fluid entering and leaving a particular reactor. The greatest deviation from this is the lead adiabatic reactor where the sharply falling temperature tends to lower the true average bed temperature. Futhermore, as catalyst particle temperatures control kinetics and the lead adiabatic reactor has the reactants with the greatest endothermic requirements and fastest reaction rates, the average bed temperature commercially would be at least 6° F. below the process fluid temperatures (average). Bulk fluid to particle gradient and the effect of sharply falling temperature are neglected for all cases in calculating average bed temperatures. Neglect of these factors makes the figures for the application of the alkylcyclohexane converter conservative.

Example 1 Base with Inlet Hydrogen Recycle Only, SOC Temperature °F.

| Adiabatic Reactor | Inlet | Bed Temperature Drop | Outlet | WABT |
|---|---|---|---|---|
| No. 1 (lead) | 890 | 120 | 770.0 | 830.0 |
| No. 2 | 900 | 95 | 805.0 | 852.5 |
| No. 3 | 915 | 50 | 865.0 | 890.0 |
| No. 4 (terminal) | 970.9 | 26.8[b] | 944.1 | 957.5 |
| Overall | | 291.8 | | 907.4 |

[b]Corresponds to the 30.3 Btu/lb naphtha feed considering the sensible heat only of the process fluid stream leaving the No. 3 adiabatic reactor. It may be noted that Pfefferle's novel solution of supplemental hydrogen to the terminal adiabatic reactor has a dual effect of not only decreasing catalyst deactivation rates due to the higher mass transfer coefficients (transport of coke precursors) and higher hydrogen partial pressures in the controlling terminal adiabatic reactor, but of decreased SOC terminal reactor inlet (5.9° F.) so that a greater operating temperature range is provided for the onstream effects before requiring more costly metallurgy as well as being subject to greater declines in hydrogen and pentane plus yields. Although aromatic selectivity for paraffin dehydrocyclization reaches a peak in the vicinity of 960° F., and then only gradually declines, any pentanes entering both from the primary hydrocracking occurring in the preceding stages together with that introduced by the hydrogen recycle can only undergo secondary hydrocracking with significant methane and ethane byproducts which not only consume hydrogen, but decrease the hydrogen content of the recycle which, in turn, further increases carbonaceous rates. Under moderate temperature reforming conditions, single pass pentane disappearance is of the order of 5 to 6% based upon reported commercial tests where pentanes were added to the naphtha feed.

| Example 1 Base Modified with Alkylcyclohexane Converter[c], SOC Temperatures °F. | | | | | | | |
|---|---|---|---|---|---|---|---|
| Adiabatic Reactor | Inlet | Endothermic[d] Requirement Btu/lb Naphtha feed | Bed Temperature Drop | Outlet | WABT | Increase Over Base Outlet | Increase Over Base WABT |
| No. 1 | 900 | 95.1 | 95.6 | 804.4 | 852.2 | +34.7 | +22.2 |
| No. 2 | 915 | 77.7 | 75.1 | 839.9 | 877.5 | +39.9 | +25.0 |
| No. 3 | 930 | 42.2 | 39.7 | 890.3 | 910.2 | +25.3 | +20.2 |
| No. 4 | 934.1 | 23.4 | 21.8 | 912.3 | 923.2 | −30.9 | −34.3 |
| | | 238.4 | 232.2 | | 902.4 | | |

[c]Supplemental hydrogen discontinued completely.
[d]Proportioned using base distribution fraction. This is conservative because the increase in naphthene stages WABT and the decrease in terminal adiabatic reactor WABT which should decrease the fraction for the terminal adiabatic reactor resulting in a lower bed temperature drop for the terminal adiabatic reactor. The significant increase in outlet temperatures for the naphthene stages means that the equilibria for lower carbon number naphthenes should always be favorable.

The hydrogen recycle compression power decreases significantly more than that previously indicated in the application for equal adiabatic reactor inlet temperature pattern reformers as the modified base circulates only 0.204 of the former weight flow. The cooling requirements for the reactor effluent cooler significantly reduces because the total mass being cooled changes from 1.720 lb/lb naphtha feed to 1.147 lb/lb naphtha feed, and the inlet temperature from the inlet feed-reactor effluent heat exchanger decreases because of the reduced duty as this heat exchanger cools the reactor effluent from 700° F. instead of 930° F. for the base and with a decreased mass flow. The shellside pressure drop for the alkycyclohexane converter, which is added, should be more than compensated by the decreased pressure drop in the reactor effluent cooler. The separator temperature decreases because of the lower outlet temperature for the cooler (close approach to the cooling medium) which, by phase equilibria effects, further increases the hydrogen content of the recycle and the byproduct hydrogen. The higher purity of the hydrogen recycle from this further cooling was ignored as well as the lower hydrogen partial pressures which would have resulted in the reactor from decreased pressure drops. Driver requirements for the modified case are estimated at 34% of the base requirements, even though a longer onstream cycle can be expected due to the decrease of average terminal adiabatic reactor temperature of 34.3° F. compared to base. This more than compensates for the elimination of the supplemental hydrogen recycle from a deactivation viewpoint.

| Example 1 Fired Heater Comparison | Base °F. | Base Btu/lb Naphtha Feed | Process of Invention Modified Base °F. | Process of Invention Modified Base Btu/lb Naphtha Feed |
|---|---|---|---|---|
| Charge heater | 825 to 890 | 66.4 | 760 to 900 | 137.5 |
| No. 2 reactor interheater | 770 to 900 | 136.2 | 804.4 to 915 | 112.3 |
| No. 3 reactor interheater[e] | 805 to 915 | 108.0 | 839.9 to 930 | 94.0 |
| No. 4 reactor interheater[f] | 865 to 965 | 116.8 | 890.6 to 934.1 | 46.2 |
| No. 4 reactor interheater | 825 to 965 | 123.2 | | — |
| Total | | 550.6 | | 390.0 |
| Less Additional endothermic requirements due to selectivity | | | | 25.5 |
| | | | | 364.5 |

[e]No. 3 reactor effluent duty.
[f]Supplemental hydrogen recycle duty.

Providing credit only for the theoretical incremental energy added due to increased selectivity is conservative because the incremental hydrogen results in approximately a 0.6 research octane clear gain. Conoco (1974 NPRA Q & A Session) reported that the energy consumption required for increasing the product quality from 96 to 100 research octane clear approximated 90,000 Btu per barrel. This corresponds to 50.9 Btu/lb naphtha feed for a 0.6 research clear octane gain. Conoco's reported figure provides for direct heat input into the fired heaters, pump and compressor horsepower.

The fired heater duties for the alkylcyclohexane converter modified case is only 66% of the base.

A significantly longer onstream cycle time, which it is reasonable to expect further reduces utilities as the utilities consumed in regenerating every six months approximates 2½% of the onstream utilities.

According to the present invention, I provide a catalytic reformer process for the production of hydrogen and a product of enhanced aromatic content from a naphtha feedstock in which the feedstock is subjected, in stages, to naphthene conversion in an ascending temperature pattern reactor, before entering a conventional adiabatic reactor section. The heat in the effluent from the terminal adiabatic reactor stage is utilized in an alkylcyclohexane converter, by means of simultaneous heat-exchange, to provide the endothermic heat of reaction required in the alkylcyclohexane converter for the dehydrogenation to aromatics of the original alkylcyclohexanes in the feed, before the said feed enters a conventional adiabatic reactor section, or before the feed enters an alkylcyclopentane conversion reactor, which would be intermediate the conventional adiabatic reactor section and the alkylcyclohexane conversion section.

By simultaneous heat-exchange, as indicated, the effluent from the terminal reactor of the conventional adiabatic reactor section is utilized to provide heat to the inlet to an alkylcyclohexane converter. In addition, the stack gases, having a temperature of 1200° to 1400° F., and normally previously employed to heat steam, are employed, particularly, to heat the inlet feed to the alkylcyclopentane converter. In this manner, the effluent from the last stage of the conventional adiabatic reactor is reduced from 930° F. to approximately 700° F. and, in a countercurrent flow, raises the feed inlet to the tube side of the catalytic reaction from 600° F. to 750° F.

The process of the present invention can be used, advantageously, to modify any of the major commercial adiabatic reactor arrangements, all of which possess an inherent kinetic deficiency in converting naphthenes. The present invention takes full advantage of the lower operating pressure to dehydrogenate the original naphthenes in the feed, more selectively, into aromatics. The process of the present invention takes better advantage of these lower operating pressures and dehydrogenation of the original naphthene and other higher boiling paraffins in the feed, accomplishing these conversions more selectively.

Reference is now made to the accompanying drawings in which.

Figure 1:
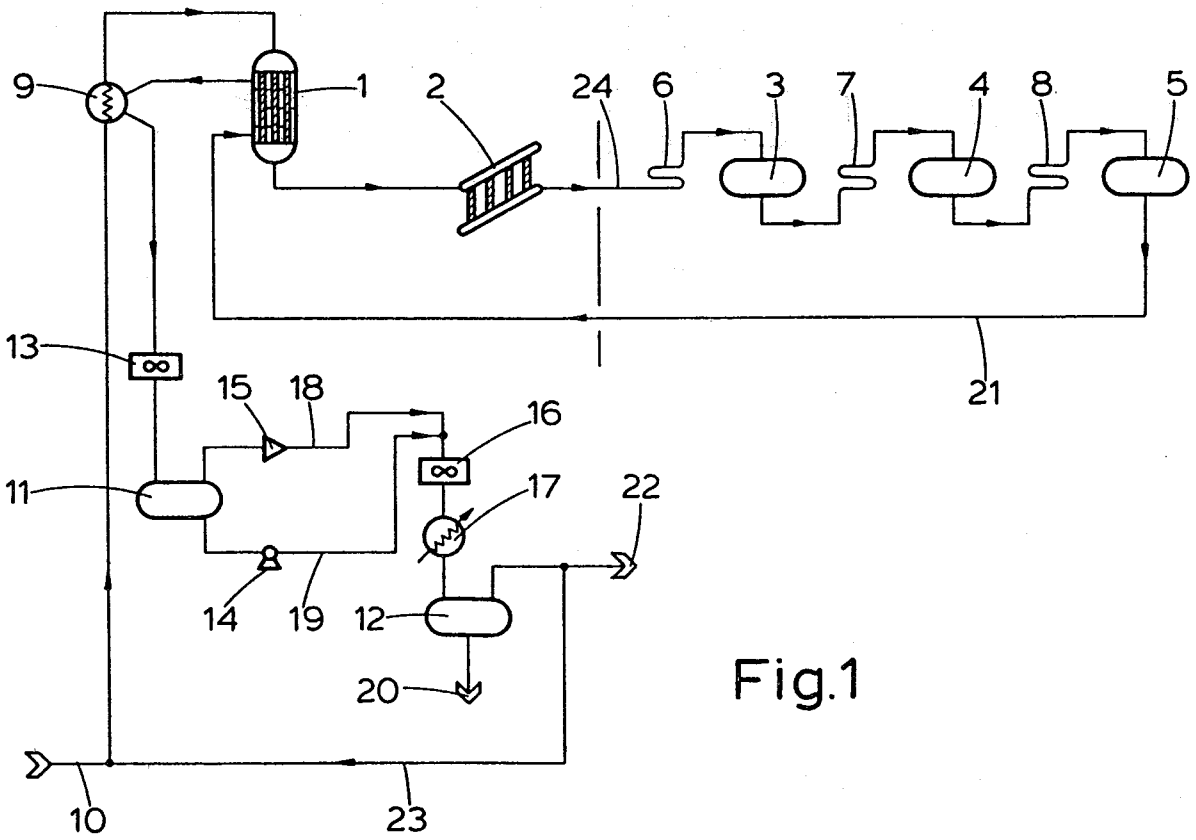
FIG. 1 is a flow sheet of one embodiment of the process of the invention using a semi-regenerative reactor arrangement.

The apparatus shown in FIG. 1 comprises an alkylcyclohexane converter 1 and an alkylcyclopentane converter 2. These are followed by a series of three reactors 3–5, namely, a lead adiabatic reactor 3, an intermediate adiabatic reactor 4, and a terminal adiabatic reactor 5. Each of these reactors is provided with a fired heater, namely, the lead heater 6, the intermediate heater 7, and the terminal heater 8. It will be appreciated that there may be more than one intermediate reactor and heater.

A feed/reactor effluent heat-exchanger is provided at 9, a separator at 11, and a hydrocarbon collector at 12.

A reactor effluent air cooler 13 is provided in the flow between the terminal adiabatic reactor 5 and the separator 11. A recontact pump 14 is provided in the flow between the separator 11 and the collector 12, and a compressor 15 is provided in the hydrogen recycle line between the latter units. The pump 14 and compressor 15 are followed in the recycle by a recontact air cooler 16 and a recontact trim cooler 17.

Hydrocarbon feed enters the system at 10 and passes through the heat-exchanger 9 into the converters 1 and 2, respectively, and through the reactor arrangement 3–8. Terminal reactor effluent 21 is returned to the alkycyclohexane converter, and via the exchanger 9 and air cooler 13 to the separator 11. Hydrogen is recycled through the line 18 via the compressor 15, and hydrocarbon liquid is recycled through the line 19 via the pump 14. Hydrocarbon liquid is withdrawn at 20 from the collector 12 either to separation or to recontact with hydrogen by product. Hydrogen by-product is taken off at 22 ad a hydrogen recycle to the main feed 10 is provided at 23.

Recontacting, or direct recycle, to the feed inlet by the hydrogen recycle compressor, though illustrated in accordance with the present Figures, is optional. Whatever the arrangement of the recycle for any given phase, the process of the invention offers significant utility and yield advantages, including increased hydrogen purity for the hydrogen byproduct stream.

Figure 2:
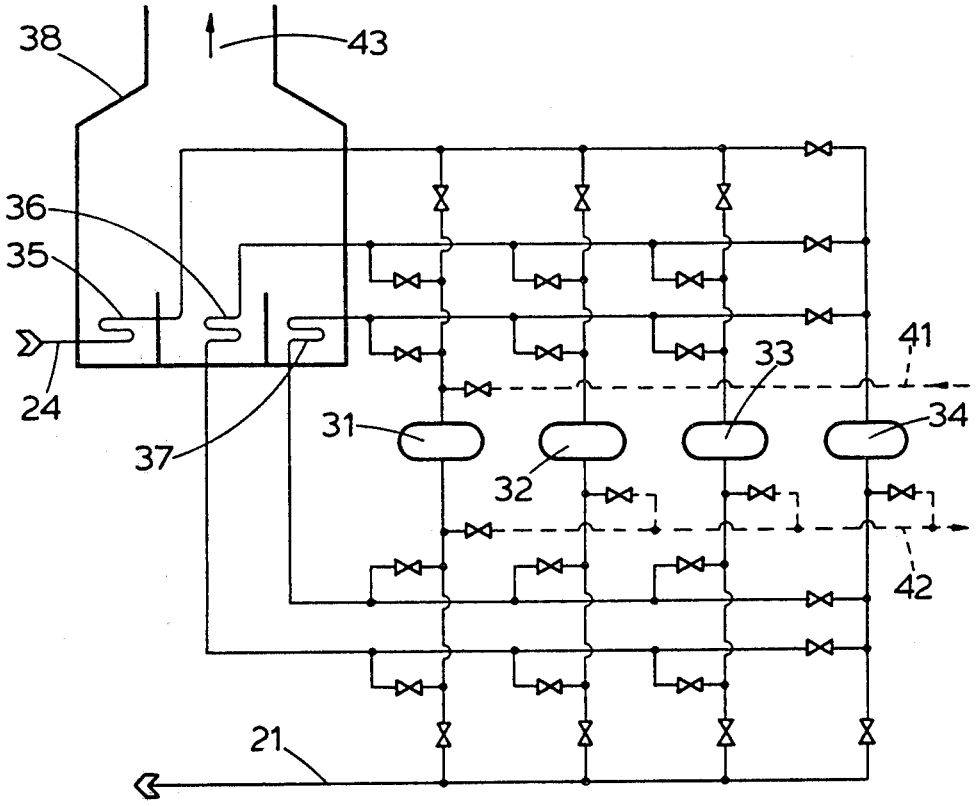
FIG. 2 is a flow sheet of the process of the invention applied to a cyclic or swing reactor arrangement.

FIG. 2 shows the application of the process of the invention to a cyclic or swing reactor arrangement. The fragment shown in FIG. 2 corresponds to the right-hand portion of the equipment shown in FIG. 1 but, in this case, there are four reactors, 31 to 34, inclusive. In operation, three of these reactors are onstream while one is regenerating. According to one modification, the arrangement may comprise a further adiabatic reactor with its fired reheater so that four reactors may be onstream while one is regenerating.

The reactors are provided, as in the case of the arrangement of FIG. 1, with fired heaters, three such heaters, 35 to 37, inclusive, being shown. The heater 35 corresponds to the lead reactor position, the heater 36 to the intermediate reactor position, and the heater 37 to the terminal reactor position. The heaters 35 to 37 are combined within a furnace 38.

The flow into the reactor arrangement enters at 24, e.g., leaving the alkylcyclopentane converter (as in FIG. 1). Terminal reactor effluent is recycled at 21 also as in FIG. 1. An entering flow 41 from regeneration equipment (not shown) is shown in dotted lines and the return to the regeneration equipment is indicated, also in dotted lines, at 42. The regeneration equipment has its own heater and is assumed to be in the recirculation condition. Flue gases leave the furnace 38 to 43.

The continuous reactor arrangement shown in FIG. 3 again corresponds to the right-hand portion of the apparatus of FIG. 1. In this case, the three reactors 52–54, inclusive, are superposed upon one another in a single column 51. Each of the three reactors, namely the lead reactor 52, the intermediate reactor 53, and the terminal reactor 54, is provided with its fixed heater.

A regeneration vessel is provided at 55 and surge hoppers 56 and 57 are included in a regeneration flow 58 which is shown in dotted lines. The regeneration vessel 55 is provided with a heater, recirculation, conditioning equipment, and the necessary connections (not shown). Pneumatic transport for the stream of small catalyst particles is provided in the regeneration line 58, and a lift hopper 59 is positioned at the base of the column 51. Hydrogen enters at 61.

The feed from the alkylcyclopentane converter 2 (FIG. 1), for example, again enters at 24, and the terminal reactor effluent, which heats the alkylcyclohexane converter 1 (FIG. 1), leaves the base of the column 51 at 21.

Figure 4:
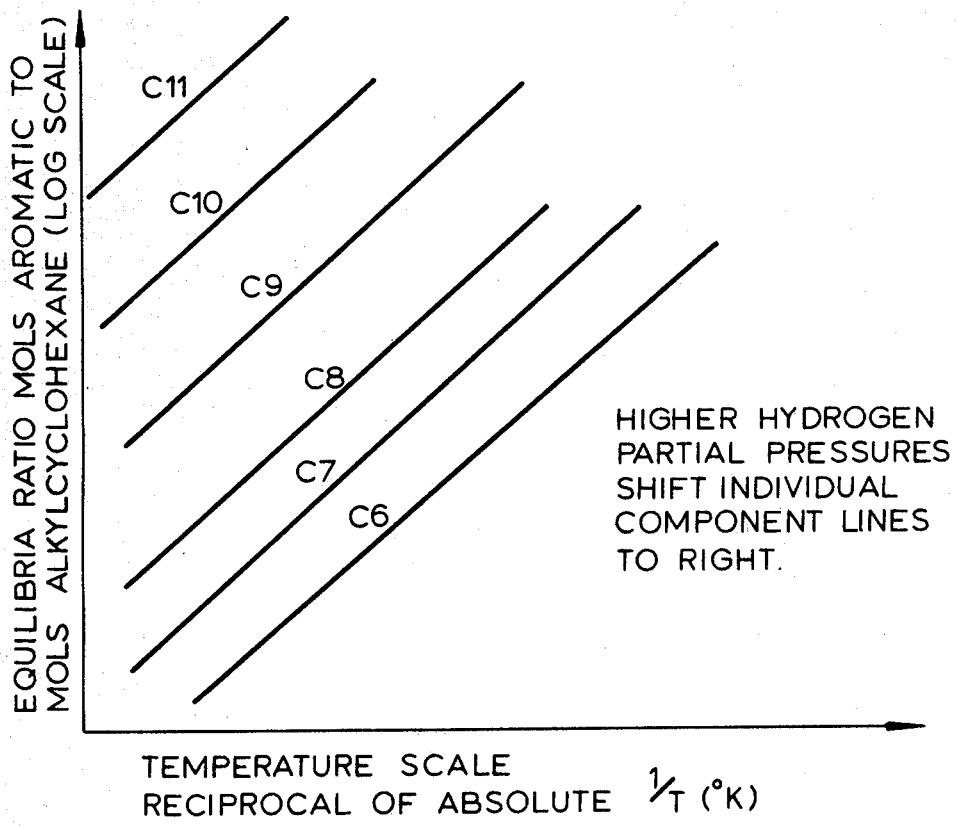
FIGS. 4 and 5 are graphs of equilibria ratios of mols of aromatics to mols of alkylcyclohexane.

The graph of FIG. 4 represents the equilibria ratios of mols of aromatics to mols of alkylcyclohexane. These are plotted as ordinate values on a logarithmic scale in relation to abscissa values which are reciprocals of absolute temperature (°K.). It should be noted that higher hydrogen partial pressures shift the individual component lines of the graph to the right.

Figure 5:
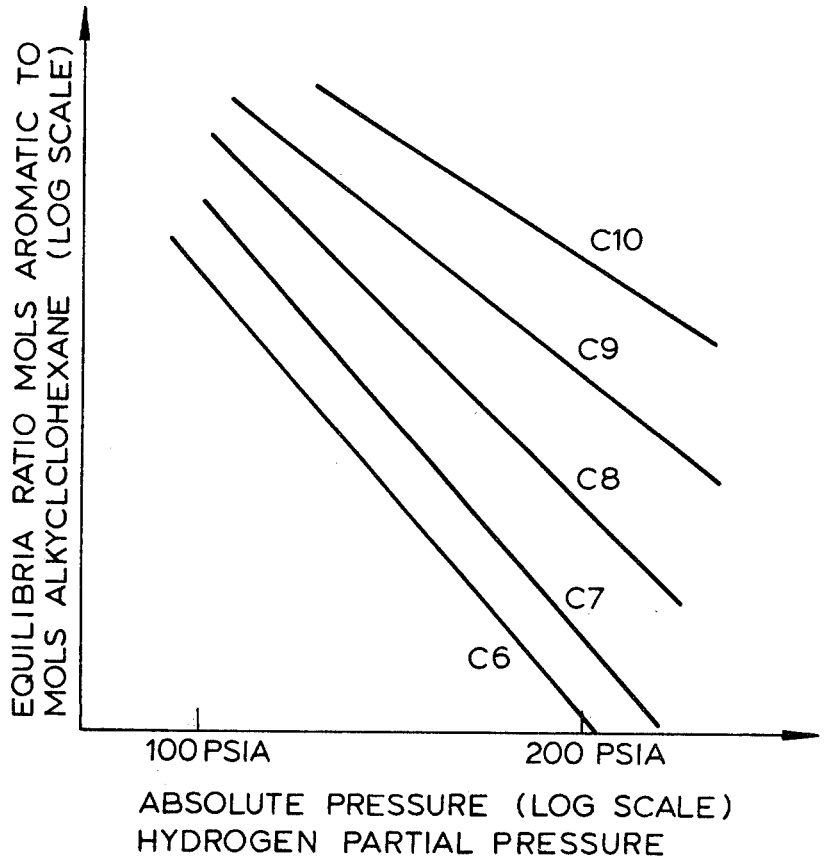

FIG. 5 is a graph of the equilibria ratios of mols of aromatics to mols of alkylcyclohexane, and is again plotted on a logarithmic scale but in relation to hydrogen partial pressures. The latter are also on a logarithmic scale and are expressed as absolute pressures. It should be noted that higher temperatures shift the individual component lines upwards.

Figure 3:
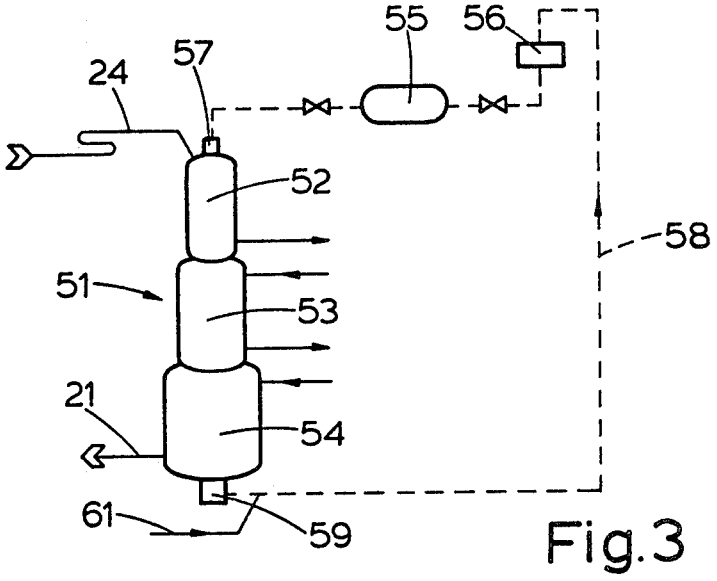
FIG. 3 is a flow sheet showing the process of the invention applied to a continous reactor arrangement.

As stated above, FIG. 1 shows the process of the invention applied to a semi-regenerative reactor arrangement, FIG. 2 shows the process of the invention applied to a cyclic or swing reactor arrangement, and FIG. 3 shows the process of the invention applied to a continuous reactor arrangement. However, the process of the invention may also be applied advantageously to a hybrid of these arrangements, such as using semi-regeneration for the lead and intermediate reactor(s) and having two terminal reactors in parallel with double block valves and separate equipment for regeneration onstream similar to the cyclic regenerative arrangement. This enables long run lengths equivalent to the maintenance shutdown requirements as the lead and intermediate reactors have a considerably lower carbonaceous deposition pattern than the terminal reactor position. The lower carbonaceous rate for the lead and intermediate reactor positions can be ensured by placing maximum inlet temperature restrictions on these reactor positions. The terminal reactor position can be periodically regenerated onstream with the processing rate being lowered during the regeneration, and the full feed resumed upon placing the regenerated catalyst in the terminal reactor position. The process of the invention, therefore, is a general improvement and is not restricted to a specific reactor arrangement or a specific catalyst.

Any adiabatic reactor arrangement, unmodified by the process of the invention, subjects the entire saturates in the feed to thermal cracking temperatures in the fired heater to the lead reactor, as the inside surface temperatures of the radiant heated tubes, which generally provide final heating to reactor inlet temperatures, are approximately 50° F. hotter than the bulk fluid temperature. Thermal cracking significantly increases the hydrogen consumption per mol of feed component over hydrocracking. Methane, ethane, and propane are the principal by-products regardless of the saturated component cracked as any ethylene or propylene intermediate is hydrogenated in the reactor. The entering paraffins, except for any components thermally cracked, are at feed concentration, and are thus subject to significant hydrocracking losses in the lead reactor because of the high entering temperature.

Although a higher temperature increases all the reaction rates, the paraffins of given carbon number cannot take advantage of this until the original alkycyclohexanes of the same carbon number have been sufficiently lowered in concentration for a favorable thermodynamic equilibrium to exist, as the paraffin dehydrocyclization into alkylcyclohexanes is a reversible reaction (alkylcyclohexanes can also decyclize the hydrogenate to form paraffins, and do so at the higher inlet temperatures when at maximum temperatures). The dehydrogenation of alkylcyclohexanes into the alkylcyclohexane intermediate, and further dehydrogenation into aromatics (alkylbenzenes) is also a reversible reaction which is subject to thermodynamic equilibria. The alkycyclohexane reaction is a very fast reaction. The alkylcyclohexane dehydrogenation into an alkylcyclohexene intermediate, while fast when compared with the other reactions which occur, is slow as compared with the alkylcyclohexene dehydrogenation into aromatics. The alkylcyclohexane dehydrogenation into the alkylcyclohexene intermediate, therefore, controls the lowering of the original alkylcyclohexane concentration, and time is required. In the meanwhile, while the high original concentrations in the feed are being sufficiently reduced by conversion to aromatics, alkylcyclohexanes are being lost to the competitive reactions provided thermodynamic equilibria permit the formation of paraffins and alkylcyclopentanes, because these competitive reaction rates have been speeded up by the high temperatures prevailing at the inlet of the reactor. Thus, these original feed components can only proceed directionally towards hydrocracking as all aromatics formed must proceed through the alkylcyclohexene dehydrogenation intermediates. The alkylcyclopentanes, being initially prevented by the thermodynamic equilibria from ring isomerization into alkylcyclohexanes can only ring open and hydrogenate to form paraffins which reinforce the hydrocracking reaction losses. This reaction is a reversible reaction in that paraffins may also dehydrocyclize into alkylcyclopentanes, but this competitive pathway is not available until the original concentration of the original alkylcyclopentanes has also been lowered to the point where a favorable thermodynamic equilibrium exists for the paraffins.

Higher temperatures unfavorably affect the molar ratios at thermodynamic equilibria which are important for the selective conversion of the original naphthenes in the feed into aromatics. The ring isomerization of alkylcyclopentanes into alkylcyclohexanes is a good example of this effect, as this equilibrium, unlike the dehydrogenation or dehydrocyclization reactions (favored by a lower hydrogen partial pressure because hydrogen is produced), or the reverse reactions (favored by a higher hydrogen partial pressure because hydrogen is consumed), is little affected by hydrogen partial pressure. For example, mols of alkylcyclopentanes per mol of alkylcyclohexane at thermodynamic equilibria are:

| | 750° F. | 800° F. | 900° F. |
|---|---|---|---|
| $C_6$ naphthenes | 7.8 | 9.0 | 11.5 |
| $C_7$ naphthenes | 2.5 | 2.7 | 3.2 |
| $C_8$ naphthenes | 0.19 | 0.265 | 0.43 |
| $C_9$ naphthenes | 0.05 | 0.087 | 0.175 |

The inlet temperatures to the lead reactor in conventional adiabatic prior art processes are generally higher than 900° F., and higher than 890° F. for Magniforming. For the increased octane requirements, with increasing lead additive legal restrictions, particularly in the United States, inlet temperatures for an equal reactor inlet pattern are typically, for the United States, when processing hydrotreated straight-run feedstocks similar in quality to naptha derived from Kuwait crude, substantially 930° F. for the start of the run conditions, with a semi-regenerative reactor arrangement. The other reactor arrangements generally employ higher reactor inlet temperatures than the 930° F. which would be typical for cyclics and continuous reforming arrangements, as the catalyst inventory is generally smaller due to the ability to regenerate onstream in order to compensate the catalyst deactivation. Furthermore, continuous processing reactor arrangements do not normally regenerate the catalyst in the reactors at shutdown unless entering a reactor is required during shutdown, whereas a semi-regenerative reactor arrangement starts up with freshly regenerated catalyst in all reactors as the hydrogen circulating equipment is employed for regeneration. Each semi-regeneration run, thus, commences with fresh catalyst, as in the initial start-up with new catalyst. In the case of heaters designed for an equal reactor inlet pattern, if octane requirements increase, one commences with a higher start of run inlet temperature to the adiabatic reactors in order to meet the quality demanded.

The process of the invention, in contrast, typically commences with an inlet temperature of the order of 600° F. into the alkylcyclohexane converter. This lower entering temperature together with an outlet temperature of approximately 750° F. for the alkylcyclohexane converter significantly lowers the hydrocracking activity in addition to lowering the competitive reactions which cause loss of the original alkylcyclopentane and alkylcyclohexane components in the feed. One alkylcyclohexane is converted to a component having a slower reaction rate for the overall conversion into aromatics; additional hydrocracking is inevitable even though part of this component is latter converted into aromatics.

As may be seen from the latter favorable thermodynamic equilibrium at 750°-800° F. as compared with 900° F., the ring isomerization of alkylcyclopentanes into alkylcyclohexanes can commece sooner if the alkylcyclohexanes are dehydrogenated at a lower temperature. This decreases the conversion of alkylcyclopentanes into paraffins, particularly for the higher carbon numbers which also have the highest reactivity.

The rising temperature gradient of the naphthene reactors of the process of the invention contrasts with the sharply falling temperature in the lead reactor of conventional catalytic reformers. Although the adiabatic stage reactors in conventional systems may have an outlet temperature of 750°-800° F., similar to the outlet temperature of the cycloalkyl converter, any hydrocracking or conversion of the original alkylcyclohexanes to alkylcyclopentanes and paraffins from higher temperatures than required represents a permanent decrease in molar selectivity in converting the original alkylcyclohexanes into aromatics. Reactivity of the various components favors the rising temperature pattern as reactivity of any of the reversible reactions sharply increases with carbon numbers. The order of the reaction rates at 750°-800° F. is indicated below:

| Component | Reactivity |
|---|---|
| $C_6$ | Base rate |
| $C_7$ | 4 times base rate |
| $C_8$ | 12 times base rate |
| $C_9$ | 30 times base rate |
| $C_{10}$ | 60 times base rate |
| $C_{11}$ | 90 times base rate |

This increase in reactivity with increase in carbon number is well suited to a rising temperature pattern because, once a saturate is converted to an aromatic, the component can be considered thermally stable. In contrast, the thermal stability of the saturates decreases with increases in carbon number. The foregoing reactivity orders change with increase in temperature as chemisorption effects become less important. The hydrocracking reactivity of paraffins also increases with carbon number, but the orders are different from the reversible reactions, being approximately as follows:

| Component | Reactivity |
|---|---|
| $C_6$ | 0.56 base rate |
| $C_7$ | 0.76 base rate |
| $C_8$ | Base rate |
| $C_9$ | 1.28 base rate |
| $C_{10}$ | 1.60 base rate |

Because the higher carbon numbers have the most favorable thermodynamic equilibria (see FIG. 4), for a given hydrogen partial pressure, a rising temperature gradient reactor can commence at a lower temperature and be more selective in converting the components which have the least thermal stability as lower temperatures permit the porous catalyst preferentially to adsorb the highest carbon numbers, whereas higher temperatures diminish the chemisorption effects.

Because reactivities refer only to a given carbon number and each carbon number has its own thermodynamic equilibrium restraints for a given temperature and hydrogen partial pressure, the general practice of a single line representing thermodynamic equilibrium behavior prevailing in catalytic reforming reactors is misleading. FIG. 5 shows the mols of aromatics per mol of alkylcyclohexane at thermodynamic equilibrium as in FIG. 4, but shows the effect of hydrogen partial pressure upon the individual carbon numbers for a given temperature. As may be seen, a lower hydrogen partial pressure favors the conversion of any alkylcyclohexane into aromatics. At 140 psia hydrogen partial pressure, even the $C_6$ component has a favorable equilibrium at 800° F., which allows conversion of a significant portion of the original cyclohexane into benzene.

Although one generally considers the alkylcyclopentane isomerization reaction into alkylcyclohexane as slow when this is compared with the dehydrogenation rate of alkylcyclohexanes into aromatics, one must consider the carbon numbers because of increased reactivity with carbon number.

The highest carbon number ring isomerization is, therefore, comparable in rate to the lowest carbon number alkylcyclohexane dehydrogenation rate. Thus, the more preferential enhancement of the depletion of the original alkylcyclohexanes in a rising reactor means that considerable $C_9$ and higher alkylcyclopentane conversion into aromatics should occur concurrently with the cyclohexane conversion into benzene, which may be expected to occur near the reactor outlet. Reactions for the lower carbon number alkylcyclohexanes occur later as the platinum dehydrogenation sites in the early part are preferentially occupied with the dehydrogenation of the higher carbon number alkylcyclohexanes into aromatics until their original concentration drops sufficiently to permit more competitive access.

With a higher platinum content, the catalyst may be considered for the naphthene conversion, as the alkylcyclohexane dehydrogenation reaction into aromatics occurs only at these sites, and reaction rates at these sites have been shown to be transport-controlled. Doubling the platinum concentration of the catalyst essentially doubles the reaction rate and halves the conversion loss of cyclohexane into methylcyclopentane while depleting the original cyclohexane.

With hourly space velocity of approximately 20 for the alkylcyclohexane converter, the expenditure for additional platinum is justified, particularly as the expenditure not only improves the kinetics of the alkylcyclohexane converter, but, also, lowers the temperature of the converter. This is because available platinum sites limit the endothermic heat removal reactions which are afforded by the high reactivity of higher carbon number alkylcyclohexanes. The alkylcyclohexane converter is limited by the heat transfer requirement and not by the availability of alkylcyclohexanes in the feed. Accordingly, by lowering the temperature rise additional platinum sites direct more of the sensible heat available in the reactor effluent to providing endothermic reactions. The prime purpose of the alkylcyclohexane converter is to reduce the original alkylcyclohexane content as soon as possible because higher temperatures can only reduce the molar selectively for the conversion of naphthene components into aromatics.

The alkylcyclohexane content of hydrotreated straight run feedstocks typically varies with the feedstock, ranges, as fractions, being 0.34 to 0.69 for the $C_6$ naphthenes, 0.38 to 0.79 for the $C_7$ naphthenes, and 0.55 to 0.84 for $C_8$ naphthenes. The fraction of alkylcyclohexanes, as can be seen, increases with increasing carbon number; yield enhancement with the process of the present invention may be expected to increase with an increase in cutpoint. As naphthene contents also generally increase with increase in cutpoint, one may expect that what is termed the alkylcyclopentane converter in this invention, using flue gas from the fired radiant heater sections, applies normally to a limited naphthene content feedstock such as illustrated in the example discussed below. The first portion of this converter continues the dehydrogenation of the alkylcyclohexanes for higher naphthene content feedstocks. The alkylcyclohexane converter has limited reactor volume, and, with limited sensible heat available in the reactor effluent from the terminal reactor, can dehydrogenate only a limited quantity of alkylcyclohexanes into aromatics.

An increased amount of naphthene dehydrogenation may be expected with a higher cutpoint feedstock, as the higher carbon numbers have a higher reaction rate, but, as temperature levels also fall under such conditions, this acts to retard the reaction rate, so that the alkylcyclohexane converter outlet temperature typically is not more than 20° F. below the design value. On the other hand, an increase in reactor effluent temperature, such as occurs in semi-regenerative reactor systems even at the end of the run typically does not increase the alkylcyclohexane converter temperature by more than 20° F., because of the compensatory increase in reaction rates with increase in temperature. Thus, the alkylcyclohexane converter acts to compensate either for variation in the feedstock or for variations in the reactor effluent temperature, so that cooling duties for the reactor effluent in a semi-regenerative reactor arrangement should remain relatively constant rather than increasing as the run progresses for a semi-regenerative reactor arrangement. The fired heater duties for maintaining the necessary reactor inlet temperatures to the adiabatic reactor should also be less affected by variations in reformer feed quality and be subject to less variation from start of run to end of run.

The process of the invention provides a solution to the need for more efficient use of the increased molar sensible heat available in the reactor effluent as compared with the reactor feed. A decrease in operating pressure significantly decreases the hydrocracking byproducts relative to the aromatics formed. The effects are demonstrated for the $C_7$ saturate components entering in the feed, with methyl cyclohexane to toluene typifying the naphthene dehydrogenation reactions, and normal heptane to toluene typifying the paraffin dehydrocyclization reactions. The reactions are:

Naphthene dehydrogenation $C_7H_{14} \rightarrow C_7H_8$ (toluene) $+ 3H_2$

Paraffin dehydrocyclization $C_7H_{16} \rightarrow C_7H_8$ (toluene) $+ 4H_2$

At 900° F., the total molar sensible heat for the products per mol of naphthene feed converted at 87.6 Btu per °F. is compared with 77.3 Btu per °F. for the feed component. For each mol of paraffin converted, the equivalent figures are 95.0 Btu per °F. for the product as compared with 86.0 Btu per F. for the feed component.

Hydrocracking reactions which occur result in less sensible heat for the products as compared with the reactants. The overall effect of increased molar selectivity in the conversion to aromatics at the expense of decreased hydrocracking is even more dramatic as the hydrocracking reaction may be typified by the following overall reactions, even if the naphthene proceeds through a paraffin intermediate and the paraffin proceeds through an olefin intermediate:

Naphthene hydrocracking $$C_7H_{14} + 2H_2 \rightarrow 0.02CH_4 + 0.015C_2H_6 + 0.965C_3H_8 + 0.965C_4H_{10} + 0.015C_5H_{12} + 0.020C_6H_{14}$$

Paraffin hydrocracking $$C_7H_{16} + H_2 \rightarrow 0.02CH_4 + 0.015C_2H_6 + 0.965C_3H_8 + 0.965C_4H_{10} + 0.015C_5H_{12} + 0.020C_6H_{14}$$

For the molar sensible heat at 900° F., the products total 82.0 Btu per °F. (both cases) as compared with 91.5 Btu per °F. for the naphthene reactants and 93.1 Btu per °F. for the paraffin reactants. Thus, overall, an improved molar selectivity in the conversion of the feed component at the expense of hydrocracking results in 5 mols of additional hydrogen per mol of aromatics formed, whether from a naphthene feed component or a paraffin feed component. The increased molar selectivity effects upon molar sensible heat are equally dramatic, as the substitution of 5 mols of $H_2$ plus toluene for the previous hydrocracked byproducts at 900° F. corresponds to 102.1 Btu per °F. for each additional mol of toluene produced at the expense of hydrocracking products eliminated (82.0 Btu per °F.), so the molar sensible heat effect is equivalent to 1.245 if the decreased hydrocracking is converted to additional hydrogen and aromatics. Thus, the molar sensible heat for the reactor effluent compared with the reactor feed significantly increases with the lower pressures, and will increase further with the use of the process of the invention. If the approach temperature at the reactor effluent entrance to the reactor feed out remains the same, the duty for cooling the reactor effluent increases with lower pressures as the temperature into the air cooler must increase, based upon the feed reactor effluent heat-exchanger, providing the only heat-exchange between the terminal reactor outlet and the air cooler. Part of the excess heat can be utilized for separation but this low temperature level duty is thermodynamically better provided by extracting steam from a steam turbine.

The increased molar selectivity achieved by the process of the invention, together with the low hydrogen recycles rendered practicable without pioneering either as to mols of hydrogen per mol of hydrocarbon feed into the lead adiabatic reactor, or deviating substantially from existing hydrogen partial pressures in the terminal adiabatic reactor, further increase the molar sensible heat in the reactor effluent as compared with the feed. However, the alkylcyclohexane reactor of the invention lowers the temperature into the feed reactor effluent exchanger to approximately 680° F. as compared with the conventional temperatures of about 930° F. or higher.

This means that, if the process of the invention is applied as a retrofit to existing catalyst reformers, and the feed reactor effluent exchangers are designed for low fuel costs, such a unit using the alkylcyclohexane converter of the invention will have a reactor effluent outlet temperature to the air cooler which is lower than that achieved in the recent catalytic reforming plants with true countercurrent heat exchangers, and surfaces provided for high energy costs. This occurs because of the decreased duty corresponding to both the lower hydrogen recycle and lower reactor effluent entering temperature with the process of the invention. This results in a close temperature approach at the reactor effluent inlet of the feed-reactor effluent heat exchanger. The decreased cooling range for the reactor effluent thereby limits the effect the higher molar sensible heat for the reactor effluent as compared with the feed (hydrocarbon feed plus hydrogen recycle).

Based upon the terminal reactor effluent at 930° F. entering the alkylcyclohexane converter, an equivalent adiabatic reactor drop of substantially 85° F. may be expected. This compares with the 120° to 130° F. lead adiabatic reactor temperature drops typically occuring when reactor effluent separator pressures are below 200 psig. Most of the adiabatic temperature drop corresponds to the highly endothermic alkylcyclohexane dehydrogenation into aromatics and hydrogen, with almost insignificant offsetting exothermic hydrocracking reactions. Alkylcyclohexanes have a significantly higher endothermic heat requirement per mol of aromatics produced than any other class of saturates, as indicated below, with the heats of reaction expressed in Btu per mol of feed component converted into a mol of aromatic:

| | To Aromatics + $3H_2$ | | To Aromatics + $4H_2$ | |
|---|---|---|---|---|
| Component | Alkylcyclo hexanes | Alkylcyclo pentanes | Normal paraffins | Isoparaffins |
| $C_6$ | 94140 | 87300 | 75060 | 70920 |
| $C_7$ | 92700 | 84600 | 77780 | 73620 |
| $C_8$ | 92160 | 78840 | 79380 | 75600 |
| $C_9$ | 92180 | 75960 | 81360 | 77760 |
| $C_{10}$ | 91440 | 73800 | 82800 | 79380 |

Although paraffins appear to have the same endothermic requirements as the alkylcyclopentanes, in practice, significantly more exothermic reactions occur with the paraffins than with the naphthenes because of the associated hydrocracking, with the production of aromatics. A pronounced difference between the alkylcyclopentanes and the paraffins in effective heats of reaction occurs, as shown by the following overall conversions which are typical for adiabatic reactors, when operating under the same conditions as in the example discussed below:

| Component | Fraction of feed hydro-cracking | Fraction of feed to aromatics | Feed component hydro-cracked to that converted to aromatics |
|---|---|---|---|
| $C_6$ CH | 0.028 | 0.960 | 0.029 |
| $C_6$ CP | 0.038 | 0.916 | 0.041 |
| $nC_6$ P | 0.250 | 0.166 | 1.51 |
| $iC_6$ P | 0.258 | 0.150 | 1.72 |
| $C_7$ CH | 0.036 | 0.960 | 0.038 |
| $C_7$ CP | 0.046 | 0.945 | 0.049 |
| $nC_7$ P | 0.320 | 0.580 | 0.552 |

-continued

| Component | Fraction of feed hydro-cracking | Fraction of feed to aromatics | Feed component hydro-cracked to that converted to aromatics |
|---|---|---|---|
| $iC_7$ P | 0.330 | 0.525 | 0.628 |
| $C_8$ CH | 0.039 | 0.960 | 0.041 |
| $C_8$ CP | 0.050 | 0.944 | 0.053 |
| $nC_8$ P | 0.245 | 0.745 | 0.328 |
| $iC_8$ P | 0.254 | 0.706 | 0.360 |
| $C_9$ CH | 0.042 | 0.958 | 0.044 |
| $C_9$ CP | 0.053 | 0.947 | 0.056 |
| $nC_9$ P | 0.208 | 0.791 | 0.263 |
| $iC_9$ P | 0.216 | 0.779 | 0.277 |
| $C_{10}$ CH | 0.043 | 0.956 | 0.045 |
| $C_{10}$ CP | 0.054 | 0.946 | 0.057 |
| $nC_{10}$ P | 0.186 | 0.814 | 0.229 |
| $iC_{10}$ P | 0.193 | 0.807 | 0.236 |

Although the thermal stability of platinum-based catalysts has been greatly improved with the development of better base supports and promotors, the basic chemistry of catalytic reforming remains unaltered, e.g. fresh catalyst performances in pilot plants with promoted platinum catalyst for the same feedstock, pressure, space velocity and temperature are nearly identical to those obtained with the same supported catalyst having platinum only. Moderate differences between operating catalytic reformer units can be expected for the same feedstock and reactor effluent separator pressure, as pressure drop characteristics for the equipment, catalyst inventory and distribution, and hydrogen recycle ratios to the feed differ, in addition to operating practices for the reactor inlet firing pattern. Moderate differences for the same catalytic reformer unit may also be expected, depending upon the catalyst state, but the relationship of increased hydrocracking associated with the classes remains, as this is a function of the ease of conversion into aromatics.

A given reactor is concerned only with the feed components entering and not with the manner in which the original feed components may have been changed into a less desirable class of component, unduly hydrocracked or demethylated to lower carbon number components; i.e., conversion of the original feed components more selectively is an opportunity which, if thrown away, as in the lead adiabatic reactor of existing systems for the naphthenes, can never be regained. On the other hand, once any original feed component has been converted more selectively into aromatics and hydrogen, the succeeding reactor, no matter what its type, cannot hydrocrack any feed component previously converted, because aromatics once formed may be considered thoroughly stable under fired heater and catalytic reforming catalyst conditions. At higher temperatures, aromatics entering may be subjected to limited hydrodealkylation on the catalyst (reduced further by lower hydrogen pressures), but the aromatic ring is never destroyed.

The considerably lower temperatures at high space velocities in the alkylcyclohexane converter are responsible for the increased molar selectivity in converting alkylcyclohexanes in the feed into aromatics, as the residence time and temperature significantly reduce the hydrocracking losses which occur. The moderate temperature also limits the isomerization of the original normal paraffins (which are far above thermodynamic equilibrium values in most feedstocks) into isoparaffins. Normal paraffins convert much more readily into aromatics than isoparaffins, and have much better equilibrium values under the same conditions. Isoparaffins also produce a significant quantity of methane and ethane via gem-dialkyl naphthene reactions in forming lower carbon number aromatics from the $C_8$ and higher isoparaffins, whereas normal paraffins convert directly into the same carbon number aromatics. The rising temperature pattern of the alkylcyclohexane converter further limits the hydrocracking, as the least thermally stable alkylcyclohexanes are converted into aromatics at lower temperatures, and, therefore, are not subject to the higher outlet temperature of the converter.

The difference in hydrocracking between that for the adiabatic reactors and the alkylcyclohexanes translates directly into increased molar selectivity for the conversion of the original naphthene components into aromatics for the fraction of the feed component undergoing reaction in the alkylcyclohexane converter. Additional hydrogen resulting from this more selective conversion of the feed components into aromatics is permanent as aromtics and hydrogen enter the succeeding reactor or heater, not the components converted. Directionally, the performance of any succeeding reactor must be improved as the unconverted saturates from the original feed have been subjected to less degradation than in an adiabatic reactor system converting the same amount of alkylcyclohexane in the feed, even though this gain can only be attained by a succeeding reactor. In contrast to the lead adiabatic or intermediate adiabatic reactor of existing catalytic reformer processes, possible conflict in requirements for the alkylcyclohexane converter catalyst does not arise. For the alkylcyclohexane converter, one would select a considerably higher platinum content catalyst with low acidity, as one is only concerned with converting the original alkylcyclohexanes in the feed which require the platinum dehydrogenation sites. The low acidity reduces normal paraffin isomerization and hydrocracking.

Promoted platinum catalysts require that the feedstock be preferably hydrotreated to: less than 0.2 ppm for sulfur (desirable to prevent undue catalyst deactivation); the run length for the semi-regenerative reactor arrangement decreases with an increase in the sulfur content of the feed approximately as follows, considering 0.2 ppm sulfur content as base run length: 0.9 base run length for 0.5 ppm sulfur; 0.8 base run length for 1.0 ppm sulfur and 0.7 base run length for 2.0 ppm sulfur; less than 0.5 ppm for nitrogen (desirable in order to prevent ammonium chloride deposits in the reactor effluent coolers as well as neutralization of the acid sites); and less than 4 ppm for the water content, which is easily achieved with proper design by distillation in the hydrotreater. These feed requirements are normally met by hydrotreating the feed naphtha. The normal feed requirements for promoted platinum catalyst admirably suit the alkylcyclohexane converter because excessive water in the feed promotes hydrocracking, and sulfur in the feed attenuates the platinum sites as platinum forms a reversible sulfide which is considerably less active for dehydrogenation. The only precaution necessary for the process of the invention is that any water addition to replace water lost in the separator product stream be made after the naphthene converters of the process of the invention. Continuous water addition is generally practiced in order to maintain an optimum water concentration in the recycle gas (specific to the catalyst as related to the proper hydration of the catalyst support) for maximum pentane plus yields. Continuous chlorination is also generally practiced for the promoted platinum catalyst, typically adding 0.5 ppm of the feed to replace losses in the separator product streams; chloride addition is normally made at the inlet of the terminal adiabatic reactor, as acidity reactions are only governing for paraffin dehydrocyclization reactions, so no precautions are needed for this location.

It may be seen that the process of the invention before the adiabatic reactors permits a reduction in the conflicting requirements of these reactors, because the most reactive naphthenes in the original feed are efficiently converted into aromatics with comparatively few changes in the other original feed components which are to be converted by the following adiabatic conventional reactors. Commercial feedstocks, in contrast to pure components studied in pilot plants, contain a distribution of carbon numbers and also contain considerable amounts of other classes, even in the case of stocks classified as highly paraffinic (such as the Kuwait naphtha example), highly naphthenic (such as hydrocrackates) or highly aromatic (such as high boiling hydrotreated fluid catalytic cracking gasoline). Because of the limited molar sensible heat in the terminal reactor effluent stream, which can be economically recovered by the alkylcyclohexane converter having limited catalyst inventory, the alkylcyclohexane converter effluent may be used as feed to the lead adiabatic reactor after heating. This feed, even for a Kuwait naphtha feedstock, would contain a considerable amount of original naphthenes (principally alkylcyclopentanes), which can be more selectively converted into aromatics. However, it is often desirable, rather than feeding the effluent from the alkylcyclohexane converter directly to an adiabatic reactor, to feed this effluent, at its temperature of 750° F., to an alkylcyclohexane converter where similtaneous heat exchange with the flue gases from the adiabatic heaters is employed to convert the alkylcyclopentanes to aromatics. This results in even a better product and purer hydrogen byproduct stream.

Therefore, in its preferred form, the process of the invention follows the alkylcyclohexane converter with an alkylcyclopentane converter with moderate temperatures, but temperatures which are higher than in the alkylcyclohexane converter. Although the construction and the source of heat (preferably flue gases from the radiant fired heater sections) differ, the alkylcyclopentane converter has an ascending temperature pattern similar to that of the alkylcyclohexane converter, as the endothermic heats of reaction are provided by simultaneous heat-exchange. With an approximate entering temperature of 750° F.-800° F. (alkylcyclohexane converter outlet temperature), and an outlet temperature of approximately 840° F., flue gases from the fired radiant heater sections are well suited to supplying the necessary heat for the catalyst tubes with an increase in the overall thermal efficiency of the process.

The alkylcyclopentane route to the alkylcyclohexene intermediate, which is finally dehydrogenated into aromatics for overall paraffin decyclization, is at least as important as the alkylcyclohexane route. This means that, until the original alkylcyclopentanes are reduced to a sufficiently low concentration as required by the thermodynamic equilibria, unnecessarily high temperatures increase the hydrocracking of the paraffins and the isomerization of the original normal paraffins to less convertible isoparaffins. The time period required to reduce the original alkylcyclopentanes to a sufficiently low concentration for a transition to higher temperatures to be considered (because paraffin dehydrocyclization can then proceed without undue competition) is longer than that needed for the reduction of alkylcyclohexanes even though the average temperature is higher. Catalyst volume anticipated for the alkylcyclopentane converter is greater than that required for the alkylcyclohexane converter. Because of the importance of the dehydrogenation sites for the reactions, it is recommended that a higher platinum catalyst concentration than that used in the adiabatic converters be employed. This catalyst concentration may be an intermediate concentration such as 0.45 weight percent platinum, as compared with the 0.60 weight percent platinum recommended for the alkylcyclohexane converter and the 0.30 weight percent platinum typically used in the promoted catalyst of the adiabatic reactors. The additional expense for platinum is offset by the fact that a promoted catalyst which might require rhenium (an expensive metal), in an amount of substantially 0.3 weight percent, is not required for low temperature operation, as the sintering of platinum is negligible at the temperatures of the naphthene converters in the process of the invention.

For the alkylcyclopentanes, lower temperatures than in the adiabatic reactors result in more favorable thermodynamic equilibria (greater driving force) for conversion into the alkylcyclohexane intermediate, itself converted to aromatics. For the normal paraffins, lower temperatures reduce the reaction rate for isomerization into isoparaffins with less driving force (lower temperatures correspond thermodynamically to a higher paraffin content), and the high space velocity reduces the residence time for the reaction to occur. This, together with the lower reaction rates for the hydrocracking of the paraffins, acts to preserve the favorable normal paraffin contents until their introduction into an adiabatic reactor at high temperature when both pathways (alkylcyclohexane and alkylcyclopentane) to the desired aromatics are operational.

The catalyst volume in the alkylcyclopentane converter is consistent with reducing the flue gases from the fired radiant heater sections to a reasonable temperature approach to alkylcyclohexane feed temperatures, such as 850° F. flue gas to the stack, or further heat exchange, such as with an air preheater. With hydrogen imparting good heat transfer characteristics inside the catalyst tube, and endothermic reactions limiting the temperature rise of the fluid in a manner similar to the vaporization of water in a high-pressure steam generator, the catalyst tubes may be safely finned for more economical heat transfer. The flue gases near atmospheric pressure have comparatively poor heat transfer characteristics, as compared with hydrogen (principal component inside the catalyst tube) at approximately 150 psig, which transmits heat to the inner catalyst particles. The adiabatic equivalent temperature drop is approximately 65° F. for the alkylcyclopentane converter due to the endothermic reactions overall (slight exothermic reactions occur).

Although the pressure drop is significant for the alkylcyclopentane converter, this pressure drop affects only the hydrogen recycle compressor discharge pressure, and does not affect any of the adiabatic reactor outlet pressures. The alkylcyclopentane converter, together with the alkylcyclohexane converter for the Kuwait naphtha example discussed below, provides a net addition of 0.876 mol of hydrogen per mol of feed. The Kuwait naphtha represents a low endpoint paraffinic feedstock which contains 2.5 liquid volume percent $C_6$ paraffins. This example may be considered representative of the lower naphthene content to be encountered in commercial practice, so that the molar hydrogen recycle per mol of feed may be 2.3 for preliminary evaluation work without pioneering in commercial adiabatic reactor practice, as over 3 mols of hydrogen per mol of feed are provided when the feed is first heated to higher temperatures to enter the lead adiabatic reactor. The reduction in hydrocracking by-products due to more selective conversion of the original naphthenes in the feed into aromatics improves the purity of the hydrogen, so that approximately 20 percent less hydrocarbon by-products are recycled with the hydrogen recycle. This, together with less overall hydrocarbon by-products being formed during the processing of the feed, means that the hydrogen partial pressures in the terminal reactor are higher than are normally provided in conventional adiabatic reactors which operate with 3 mols of hydrogen per mol of feed at the same reactor effluent separator pressure. The higher hydrogen purity of the hydrogen recycle further reduces the volume of hydrogen recycle to be compressed in the process of the invention. Thus, the hydrogen compressor horsepower requirement is decreased for the same operating pressure level, as compared with existing catalytic reformers. Thus, the decrease in volume of the hydrogen cycle appreciably more than offsets the hydrogen recycle increased circuit pressure drop (allowing no credit towards the decreased pressure drop in the feed reactor heat-exchanger as a result of the alkylcyclohexane converter, or decreased pressure drop in the heaters, adiabatic reactors and aircooler because of the lower hydrogen recycle).

Hydrogen gas is, of course, a principal component of the material in both the alkylcyclohexane and alkylcyclopentane reactors. It is important to minimize the pressure drop with good heat transfer in these reactors. Preferably, this is accomplished by employing the catalyst particles in a shape which will provide turbulation of the material being processed. Catalyst particle shapes which can accomplish this include cylindrical rings, such as Raschig and Lessing rings, Berl saddles, spiral tile, grid tile, and star or lobe shaped particles.

It is recognised that adiabatic reactors require a minimum hydrogen recycle rate in order to limit the temperature drop in the lead reactor. This has been provided even though, with the process of the invention, the adiabatic temperature drops within the adiabatic reactors are considerably decreased, particularly in the lead adiabatic reactor, because the most reactive feed components have been converted into comparatively inert aromatics and hydrogen. With the process of the invention, these products are sensible heat carriers for the other reactions occurring in the lead reactor similar to the original hydrogen recycle (instead of producing endothermic reactions which quench the other reactions from ever occurring in the lead adiabatic reactor).

The process of the invention admirably suits the trend in modern catalytic reformer design of employing radiant fired heater sections exclusively to heat the feed streams to the required inlet temperatures for the respective adiabatic reactors, in order to reduce the hydrogen compressor circuit pressure drop (because compressor horsepower is related to the pressure ratio of the discharge pressure to the suction pressure in absolute terms, circuit pressure drop becomes more important the lower the operating pressure). The process of the invention provides an economical solution for the efficient use of the flue gases from these radiant fired heater sections. With an overall adiabatic temperature drop equivalent, for both the alkylcyclohexane converter and the alkylcyclopentane converter, of 150° F., heat is provided for the elimination of the hydrocracking reactions formerly occurring in the adiabatic reactors (in the conversion of the naphthenes), and is also sufficient actually to reduce the energy required for the adiabatic reactor heaters, if it is assumed that the reactor inlet temperatures remain unchanged. This is a conservative assumption as the average temperature within the adiabatic reactor bed is significantly increased for the same reactor inlet. This may be correct in a new design with lower catalyst inventories in the adiabatic reactors. The overall catalyst inventory in the process of the invention is probably decreased, particularly as the adiabatic reactors are concerned with the slower reactions and most of the catalyst volume is in the adiabatic reactors.

The foregoing should be sufficient to indicate that the process of the invention should contribute towards lowering the energy cost of existing catalytic reforming processes. However, the process of the invention also affects the kinetics of the adiabatic reactors. With feedstock costs rising, an equally important objective of catalytic reforming is the more selective production of aromatics from the feed components, whether for chemicals or for gasoline. The isomerization reactions of paraffins are unimportant contributors to the research clear octanes required currently or which may be expected in the future because of increasing restrictions on the amount of lead additive permitted in gasolines as a result of environmental concern. Typical research clear octanes for the pentane plus paraffins in 98 research clear octane reformate or above correspond to only 62 to 64 research clear octanes. These octane numbers decrease with an increase in the average temperature of the terminal reactor because the single-branched, double-branched and normally paraffins approach thermodynamic equilibria under these temperature conditions. Trimethyl branched paraffins, or the isoparaffins for the $C_7$ and higher carbon numbers with the greatest octane numbers, are present in the reformate product in low concentrations only and are far below those which might be expected on the basis of thermodynamic equilibria. Benzene has a 98 research clear octane blending number so this aromatic component may be extracted for chemical values without any effect upon the gasoline value of a 98 research octance clear reformate. Benzene is an exception to the high gasoline blending numbers of aromatics as the $C_7$ and higher aromatics have a research clear blending number of approximately 116.

Adiabatic reactors are economically suited to the slower paraffin dehydrocyclization reactions because of the catalyst volumes required and the high temperatures which require radiant fired heater sections to provide economically the conditions which favor the paraffin dehydrocyclization reactions. Even if they were suitable for the paraffin dehydrocyclization, radiant fired heater tubes filled with catalyst would be much more expensive and have an increased pressure drop. Furthermore, once the transition to paraffin dehydrocyclization reaction is permitted, without undue competition from the remaining alkylcyclopentanes, heating to higher inlet temperatures for the inlet into the adiabatic reactor is actually beneficial as it is done in the absence of catalyst. Higher temperatures, up to a certain temperature, increase the molar selectivity for the conversion of paraffin components into aromatics. This has been demonstrated by pilot plant studies with various pure paraffin components as the feedstocks. These studies show that the molar selectivity for the conversion of paraffins into aromatics generally increases with temperature up to a certain temperature, depending upon the component, i.e., although the hydrocracking rates increase with higher temperatures, the overall paraffin dehydrocyclization rates increase appreciably faster.

The problem with conventional adiabatic systems is that the lead adiabatic reactor and, possibly, the intermediate adiabatic reactor must also process naphthenes from the original feed for which they cannot perform efficiently. The process of the invention offers the solution to these conflicting requirements of essentially reducing the feedstock to paraffins being the principal remaining components in the feed to the adiabatic reactors for conversion into aromatics, i.e., the product from the alkylcyclopentane converter, at least for low naphthene feedstocks, resembles those involved in pure component pilot plant studies when the feedstock has been partially reacted into a mixture of paraffins and aromatics.

The alkylcyclopentane converter effluent in the Kuwait naphtha example does have a significant original concentration of alkylcyclopentanes remaining: namely, methylcyclopentane (approximately 30 percent of the original feed component remains unconverted) and $C_7$ alkylcyclopentanes (approximately 10 percent of the original feed component). These lower carbon number alkylcyclopentanes have the slowest reaction rates and the most unfavorable thermodynamic equilibria. Significant quantities of these components also appear in the reformate product. Even when 99.5 percent normal hexane has been charged to a pilot plant, measurable quantities of methylcyclopentane appear in the product. Similarly, when 99.5 percent normal heptane has been charged to the pilot plant, measurable quantities of $C_7$ alkylcyclopentanes appear in the product. These only confirm the thermodynamic equilibria relationships and reaction pathways. With increased reactor volumes, one may lower these alkylcyclopentanes still further towards equilibria. This might increase the selectivity of these naphthenes but, because of the considerable amount of paraffins with different reactivities due to different carbon numbers, one would probably lose overall because of poor paraffin conversion; thus, more time would be needed for the normal paraffins to isomerize to a less convertible form. The latter indicates that, unlike pure component studies, commercial feedstocks are mixtures and require a compromise. It can be seen that, once paraffins become predominant and the naphthenes are sufficiently reduced, heating in the absence of a catalyst is actually kinetically desirable as the paraffin conversion governs. This is exactly what the adiabatic reactor does, so that the combination of the process of the invention of first reducing the original naphthene content and then following with the adiabatic reactors is kinetically desirable. The moderation of the adiabatic temperature drops in the adiabatic reactors achieved by the process of the invention can only improve the adiabatic reactor kinetic performance as the bed outlet temperatures increase. For given reactor volumes, this is inevitable as the temperature drop is related to the reactivity of the components entering, and the most reactive, i.e., those components having the highest speed of reaction are insignificant in the adiabatic reactor feed due to conversion in the naphthene converters. The remaining feed components have a higher hydrocracking exothermic reaction, which offsets their endothermic heat of reaction from the aromatic formation.

ference in by-products from the hydrocracking of the various components:

By-products mol per mol of feed component hydrocracked

| Component | $CH_4$ | $C_2H_6$ | $C_3H_8$ | $C_4H_{10}$ | $C_5H_{12}$ | $C_6H_{14}$ | $C_7H_{16}$ | $C_8H_{18}$ |
|---|---|---|---|---|---|---|---|---|
| $C_6$ | 0.374 | 0.236 | 0.780 | 0.236 | 0.374 | — | — | — |
| $C_7$ | 0.020 | 0.015 | 0.965 | 0.965 | 0.015 | 0.020 | — | — |
| $C_8$ | 0.003 | 0.003 | 0.430 | 1.128 | 0.430 | 0.003 | 0.003 | |
| $C_9$ | — | — | 0.215 | 0.779 | 0.779 | 0.215 | — | — |
| $C_{10}$ | — | — | 0.134 | 0.547 | 0.678 | 0.547 | 0.134 | — |
| $C_{11}$ | — | — | 0.106 | 0.407 | 0.485 | 0.485 | 0.407 | 0.106 |

With a feed consisting entirely of a mixture of paraffins, the largest temperature drop still occurs in the lead adiabatic reactor, and the smallest temperature drop in the terminal reactor, because of the reactivities associated with the various carbon numbers and individual classes of paraffins together with the concentration differences; this would alone tend to produce a smaller temperature drop in succeeding reactors even for a one component feed if reactor volumes were equal. The principal difference encountered with the process of the invention is that the sharply falling temperature in the lead adiabatic reactor is changed into a gradual decline, as the components with the highest activities and endothermic requirements are absent from the feed to this reactor, i.e., more similar reactivities are involved as well as significantly lowered endothermic requirements per mol of aromatic produced.

The process of the invention increases the catalyst efficiency in the lead and intermediate reactors as the temperature of the lower catalyst volume of the bed is sufficiently increased for a greater paraffin dehydrocylization reaction to occur due to the higher outlet temperatures for a given inlet temperature. This more effective use of the catalyst in the adiabatic reactor results in significantly less saturates entering the fired heater for the succeeding reactor and being subject to thermal cracking conditions. Above 975° F., the hydrocracking of the pentanes (present from earlier hydrocracking reactions) becomes significant. Above this temperature, therefore, the pentanes plus yields and hydrogen purity always decrease with further increases in temperature, as, unlike the $C_6$ and higher paraffins, aromatics cannot be formed, and only methane through butanes can result. The process of the invention, through increasing the average bed temperature for a given reactor inlet, permits operation with a reasonable catalyst volume and not exceeding this temperature, even when higher octane reformates are required. With a semi-regenerative adiabatic reactor arrangement, the more efficient use of the catalyst in the adiabatic reactors results in a considerable increase in run lengths because the carbonaceous deposits within the reactor are more uniform.

What is often not appreciated is that the hydrogenolysis of hexanes results in appreciable methane and ethane by-products unlike the hydrocracking of other components. Methane and ethane because of their volatility characteristics significantly affect the hydrogen purity of the recycle gas. The hexane components subject to hydrocracking originate from the hydrocracking of the $C_9$ and higher components as they are not present generally in the original feed to the extent that they are found in the terminal reactor where the highest temperatures prevail. Although the following table is applicable for temperatures below 840° F., it indicates the difference in by-products from the hydrocracking of the various components:

The foregoing corresponds to a hydrogen consumption of 1 mol per mol of paraffin component hydrocracked and 2 mols per mol of naphthene component hydrocracked. The hydrogen consumption per mol of component hydrocracked significantly increases with higher reactor feed inlet temperatures as more methane and ethane abstractions by hydrogenolysis are superimposed upon all components, being hydrocracked together with the higher carbon number by-products being also subjected to hydrocracking as a result of their higher adsorbability by the catalyst. Thus, it may be seen that, in view of the earlier disappearance of the remaining saturate components together with the elimination of the hydrocracking by-products from the naphthenes (due to being previously converted less selectively in the adiabatic reactors), the process of this invention further lowers the production of light hydrocarbons which lowers the hydrogen purity of the hydrogen recycle in addition to increasing the hydrogen yield. This intangible has not been evaluated in the example. Higher cut point feedstocks, because they contain more $C_9$ and higher saturates, therefore favor the process of the invention.

Because the advantages of the process of the invention in the case of feedstocks of high naphthene content and higher cut point will be self-evident, Kuwait naphtha feedstock is chosen as an example. This feedstock represents a good design consideration as most refineries must consider the possibility of processing lower naphthene content feedstocks. The example represents a typical naphtha feedstock when mid-distillate winter demands must be met from Middle East crudes.

Most catalytic reformers must process a variety of feedstocks which vary with the crude available and seasonal demands. Even though designed for the example feedstock, the catalytic reformer of the invention is capable of processing a highly naphthenic feedstock much more efficiently than existing reformers. Highly naphthenic feedstock contains a considerable amount of paraffins to be dehydrocyclized into aromatics as one would generally increase the octane value of the reformate product for incorporation into a premium gasoline.

One may adapt the adiabatic reactors to this situation by limiting the lead adiabatic reactor to a suitable lower reactor inlet temperature which would convert most of the remaining naphthenes. The naphthene converters of the process of the invention automatically adjust to the new situation in that considerably more naphthenes (and almost all the alkylcyclohexanes) will be converted into aromatics than in the Kuwait design case, so that the outlet temperature from the alkylcyclopentane converter entering the lead reactor heater will be considerably lower in value. Additional heater capacity is not required because of the lower reactor inlet temperature to the lead adiabatic reactor. The remaining adiabatic reactors are operated in a normal manner suited to accomplishing the remaining paraffin dehydrocyclization requirement for the octane demand. One may, faced with continuous processing of this feedstock, wish to carry the process of the invention further and utilize radiant fired heater tubes to continue the ascending temperature pattern, in order more selectively to convert the naphthenes for such a feedstock, and then continue processing in the adiabatic reactors for the conversion of the paraffins. Such a design, while improving the overall conversion of a high naphthene feedstock, would not be as efficient as the lower cost design of the example if required to process lower naphthene content feedstocks.

Kuwait Naphtha Example

Kuwait naphtha, generally termed a highly paraffinic feedstock, illustrates that all commercial feedstocks contain a significant quantity of the other classes. PONA analysis, as it is generally stated in liquid volume percent, considerably overstates the paraffinic contribution and understates the naphthenes and native aromatics when translated into a molar equivalent. This is illustrated for the example below:

PONA, liquid volume percent P 62.8, N 28.8, A 8.4 (0.7379 specific gravity)

PONA, molar percent P 58.59, N 30.61, A 10.80 (91.08 molecular weight)

| Component | Liquid volume fraction | Specific gravity | Weight fraction | Mol fraction |
|---|---|---|---|---|
| Benzene | 0.005 | 0.8845 | 0.0060 | 0.0085 |
| $C_6$ CH | 0.013 | 0.7834 | 0.0138 | 0.0180 |
| $C_6$ CP | 0.012 | 0.7535 | 0.0122 | 0.0131 |
| $nC_6$ P | 0.020 | 0.6641 | 0.0180 | 0.0230 |
| $iC_6$ P | 0.005 | 0.6640 | 0.0044 | 0.0056 |
| Toluene | 0.027 | 0.8719 | 0.0318 | 0.0379 |
| $C_7$ CH | 0.051 | 0.7740 | 0.0535 | 0.0597 |
| $C_7$ CP | 0.043 | 0.7579 | 0.0442 | 0.0494 |
| $nC_7$ P | 0.136 | 0.6882 | 0.1268 | 0.1324 |
| $iC_7$ P | 0.101 | 0.6870 | 0.0941 | 0.1031 |
| $C_8$ A | 0.039 | 0.8720 | 0.0461 | 0.0477 |
| $C_8$ CH | 0.067 | 0.7767 | 0.0705 | 0.0690 |
| $C_8$ CP | 0.041 | 0.7730 | 0.0430 | 0.0421 |
| $nC_8$ P | 0.102 | 0.7068 | 0.0977 | 0.0940 |
| $iC_8$ P | 0.094 | 0.7061 | 0.0900 | 0.0865 |
| $C_9$ A | 0.013 | 0.8669 | 0.0153 | 0.0139 |
| $C_9$ CH | 0.029 | 0.7775 | 0.0305 | 0.0266 |
| $C_9$ CP | 0.019 | 0.7765 | 0.0200 | 0.0173 |
| $nC_9$ P | 0.068 | 0.7217 | 0.0665 | 0.0568 |
| $iC_9$ P | 0.072 | 0.7379 | 0.0720 | 0.0616 |
| $C_{10}$ CH | 0.006 | 0.7800 | 0.0064 | 0.0051 |
| $C_{10}$ CP | 0.007 | 0.7790 | 0.0076 | 0.0058 |
| $iC_{10}$ P | 0.030 | 0.7300 | 0.0297 | 0.0229 |
| Total | 1.000 | | 1.000 | 1.000 |

The Kuwait naphtha feedstock is converted into 98 research clear octane reformate with typical adiabatic reactor yields when the reactor effluent separator is 115 psia, as the base case. This base case is modified with the process of the invention being used at the same reactor separator pressure with paraffin disappearences in the adiabatic reactors maintained. Selectivity to aromatics in the adiabatic reactors for the unconverted saturates are assumed to be unchanged except for the following conservative decreases in nydrocracking of the paraffins in the lead adiabatic reactor, because paraffin dehydrocyclization reactions may commence immediately upon introduction of the feed (time temperature for a lead adiabatic reactor under start of run conditions);

| | |
|---|---|
| $C_6$ P | 0.0025 fraction of feed component entering |
| $C_7$ P | 0.0032 fraction of feed component entering |
| $nC_8$ P | 0.0044 fraction of feed component entering |
| $iC_8$ P | 0.0043 fraction of feed component entering |
| $nC_9$ P | 0.0062 fraction of feed component entering |
| $iC_9$ P | 0.0058 fraction of feed component entering |
| $iC_{10}$ P | 0.0093 fraction of feed component entering |

The decrease in hydrocracking obtained with the use of these figures is only 18 percent of the total decrease in hydrocracking produced by more selected conversion of the alkylcyclohexanes and alkylcyclopentanes in the original feed by the naphthene converters of the process of the invention. No credit has been assumed for any decrease in succeeding reactors nor has any credit been taken for the decreased hydrocracking to aromatics produced by these paraffins because of temperature conditions (more moderate temperature drops) caused by the process of the invention. It may be that the incremental gain from the process of the invention in moderating the temperature drops of existing adiabatic reactors will be even more important than the more selective conversion of naphthenes into aromatics. This is because of the existing low adiabatic temperature outlets for the lead and intermediate reactor positions, together with the considerably higher quantity of hydrocracking by-products and the much greater potential for the improvement of selectivity to aromatics of the paraffin components. Data at 100 psig for some paraffin components in the pilot plant indicate that the incremental yield of aromatics is more appreciable in the temperature range from 885° to 932° F. than for that observed above 932° F., e.g., a 1.85° F. temperature rise was approximately equivalent to a 1° F. temperature rise at 885° F., in producing the same incremental amount of aromatics.

| | Comparison summary | |
|---|---|---|
| | Adiabatic reactors before modification | Adiabatic reactors modified according to the process of the invention |
| Hydrogen recycle, mol fraction | 0.0886 | 0.906 |
| Yields, weight fraction on feed | | |
| $H_2$ | 0.0317 (1530SCF/B) | 0.0334 (1691SCF/B) |
| $C_1$ to $C_4$ | 0.1002 | 0.0862 |
| $C_5$ plus (98.0 RON clear, 0.7918 lvf on feed) (98.6 RON clear 0.8009 lvf on feed) | | |
| Paraffins | 0.2316 | 0.2266 |
| Naphthenes | 0.0130 | 0.0130 |
| Aromatics | 0.6235 | 0.6408 |
| Sub total | 0.8681 | 0.8804 |
| Total | 1.0000 | 1.0000 |
| Benzene | 0.0181 | 0.0189 |
| Toluene | 0.1477 | 0.1530 |
| $C_8$ aromatics | 0.2670 | 0.2733 |
| $C_9$ aromatics | 0.1788 | 0.1825 |
| $C_{10}$ aromatics | 0.0119 | 0.0131 |

What I claim is:

1. A catalytic reformer process for the production of hydrogen and a product of enhanced aromatic content from a naphtha feedstock which process comprises a plurality of adiabatic reactor stages in which the feedstock is subjected to conversion to aromatic products, where the heat in the effluent from the terminal adiabatic reactor stage is utilized in an alkylcyclohexane converter, wherein said alkylcyclohexane converter has an ascending temperature pattern, by means of simultaneous heat-exchange, to provide the endothermic heat of reaction required in an alkylcyclohexane converter for the dehydrogenation to aromatics of the original alkylcyclohexanes in the feed.

2. The process of claim 1, wherein, subsequent to conversion of the alkylcyclohexanes to aromatics, the effluent from the alkylcyclohexane converter is fed to further conversion reactor stages.

3. The process as claimed in claim 1 or claim 2, wherein the catalyst employed is a promoted platinum catalyst.

4. The process as claimed in claim 3, wherein the shape of the platinum catalyst promotes turbulation.

5. The process as claimed in claim 1, wherein the hourly space velocity in the alkylcyclohexane converter is 20.

6. A process as claimed in claim 1, wherein the inlet temperature to the alkylcyclohexane converter is approximately 600° F.

7. The process as claimed in claim 1, wherein the outlet temperature in the alkylcyclohexane converter is approximately 750° F.

8. A catalytic reformer process for the production of hydrogen and a product of enhanced aromatic content from a naphtha feedstock which includes alkylcyclopentanes, the improvement which comprises converting said alkylcyclopentanes to aromatic products employing simultaneous heat-exchange, the effluent from said alkylcyclopentane converter stage being fed to adiabatic reactor stages for the further conversion to aromatic materials, said simultaneous heat-exchange being carried out between said naphtha feedstock and the flue gases from the heaters for the final adiabatic reactor stage.

9. The process of claim 8 wherein alkylcyclohexanes are first converted to aromatics, and the effluent from the alkylcyclohexane conversion stage is the inlet to the alkylcyclopentane converter stage.

10. The process of claim 8 wherein the effluent from the alkylcyclopentane converter stage is the inlet to an adiabatic reactor system.

11. The process as claimed in claims 8, 9, or 10, wherein the catalyst employed is a promoted platinum catalyst.

12. The process as claimed in claim 11, wherein the shape of the platinum catalyst promotes turbulation.

13. The process as claimed in claim 8, wherein the hourly space velocity in the alkylcyclopentane converter is 20.

* * * * *